US006978995B2

(12) United States Patent
Middelberg et al.

(10) Patent No.: US 6,978,995 B2
(45) Date of Patent: Dec. 27, 2005

(54) APPARATUS AND METHOD FOR COLLECTING FLAT AND LETTER UNITS

(75) Inventors: Neal J. Middelberg, Apex, NC (US); Gerard A. DeRome, Jr., Cary, NC (US); Edward J. Kapturowski, Apex, NC (US); Ronald J. Mich, Zebulon, NC (US); Robert B. Bennett, Raleigh, NC (US); Dale R. Curry, Apex, NC (US)

(73) Assignee: Bowe Bell +Howell Company, Durham, NC (US)

( * ) Notice: Subject to any disclaimer, the term of this patent is extended or adjusted under 35 U.S.C. 154(b) by 255 days.

(21) Appl. No.: 10/034,853

(22) Filed: Dec. 28, 2001

(65) Prior Publication Data

US 2003/0085512 A1 May 8, 2003

Related U.S. Application Data

(60) Provisional application No. 60/315,532, filed on Aug. 29, 2001.

(51) Int. Cl.[7] ..... B65H 39/02
(52) U.S. Cl. ..... 271/198
(58) Field of Search ..... 271/200, 207, 271/223; 814/790.3; 414/790.3

(56) References Cited

U.S. PATENT DOCUMENTS

| | | | | | |
|---|---|---|---|---|---|
| 997,041 | A | * | 7/1911 | Collis | 271/188 |
| 3,191,927 | A | * | 6/1965 | Ellsworth et al. | 414/789 |
| 3,231,100 | A | * | 1/1966 | Faeber | 414/788.2 |
| 3,409,148 | A | * | 11/1968 | Shields | 414/790.3 |
| 3,601,265 | A | * | 8/1971 | Shields | 414/789.1 |
| 4,219,191 | A | * | 8/1980 | Rastorguyeff | 271/3.07 |
| 4,541,764 | A | | 9/1985 | Govan et al. | |
| 4,767,115 | A | * | 8/1988 | Garthe | 271/223 |
| 4,786,039 | A | * | 11/1988 | Ito | 271/3.02 |
| 4,925,362 | A | * | 5/1990 | Golicz | 414/790.7 |
| 5,016,867 | A | * | 5/1991 | Kamath | 271/209 |
| 5,044,623 | A | * | 9/1991 | Munz et al. | 271/223 |
| 5,087,026 | A | * | 2/1992 | Wyer | 271/188 |
| 5,096,177 | A | * | 3/1992 | Saeki et al. | 271/3.05 |
| 5,125,214 | A | | 6/1992 | Orsinger et al. | |
| 5,150,894 | A | * | 9/1992 | Ricciardi | 271/302 |
| 5,362,039 | A | | 11/1994 | Kusters | |
| 5,439,208 | A | | 8/1995 | Moser et al. | |
| 5,609,335 | A | * | 3/1997 | Parker | 271/302 |
| 5,634,551 | A | | 6/1997 | Francioni et al. | |
| 5,806,659 | A | | 9/1998 | Middelberg et al. | |
| 5,823,521 | A | | 10/1998 | Emigh et al. | |
| 5,899,453 | A | | 5/1999 | Middelberg et al. | |
| 6,247,691 | B1 | | 6/2001 | Drago et al. | |

FOREIGN PATENT DOCUMENTS

| | | | | |
|---|---|---|---|---|
| EP | 0 455 494 A2 | | 11/1991 | |
| JP | 59-128153 | * | 7/1984 | 271/5 |
| JP | 5-124764 | * | 5/1993 | 271/207 |

* cited by examiner

*Primary Examiner*—Donald P. Walsh
*Assistant Examiner*—Mark Beauchaine
(74) *Attorney, Agent, or Firm*—McDermott Will & Emery LLP

(57) ABSTRACT

A collector apparatus and method capable of collecting material in two modes of operation, flats and letters. With a minor adjustment, the apparatus can be transformed from a two-stage device optimal for the letter mode of operation, to a one-stage device optimal for the flats mode of operation. The apparatus includes a first staging area, a second staging area generally disposed downstream from the first staging area, and a conveying device. The first staging area includes a first staging surface and a first stage transport assembly, and the second staging area includes a second staging surface and a second stage transport assembly. The conveying device is adjustable between the flats and letters modes. In the letters mode position, the conveying device provides a first material flow path running through the first and second staging areas. In the flats mode position, the conveying device provides a second material flow path into a third staging area, which is defined by one or more components of the first and/or second staging areas.

35 Claims, 18 Drawing Sheets

APPARATUS AND METHOD FOR COLLECTING FLAT AND LETTER UNITS

CROSS-REFERENCE TO RELATED APPLICATION

This nonprovisional application claims the benefit of U.S. Provisional Application No. 60/315,532, filed Aug. 29, 2001, the disclosure of which is incorporated by reference herein in its entirety.

TECHNICAL FIELD

The present invention is directed to the handling of both flat and letter units or sets of flat and letter units. More particularly, the present invention is directed to an apparatus and method capable of being selectively adjusted or converted such that either flat or letter units can be handled by the same apparatus.

BACKGROUND ART

Many types of systems are known for effecting material handling and processing operations, particularly in the case of materials consisting of sheet or sheet-like material units such as documents, mail pieces, inserts, papers, envelopes, and the like. These systems are often arranged in a series of different apparatuses or devices that perform specific handling and/or processing operations. Such operations can include bulk loading, singulating, registering, sorting, staging, accumulating, folding, printing, shearing, merging, envelope stuffing, envelope wetting, envelope sealing, and combinations thereof. Moreover, the systems define one or more flow paths for one or more streams of material units or sets of material units. Given that many different operations can be performed on one or more streams of material units, the various operations and their respective apparatuses must be coordinated through timing and synchronization while maintaining a commercially acceptable level of throughput.

In some of these operations, two or more sheet streams must be merged into a single stream. One example is the processing of two-up material, which typically is provided on a 17 inch continuous roll. The width of the roll is such that two 8.5×11 inch printed pages are disposed in adjacent relation to each other. Several side-by-side pairs of such pages are contained in succession along the length of the roll. The pages are individualized in separate sheets and sheet streams by using one or more cutting devices.

A staging module is typically used whenever an application requires that one or more sheets in one or more process streams be paused or held for a certain period of time while other operations are performed, initialized, or reset. In operations such as those briefly described above, the use of a staging module can be useful for assisting in the synchronization of the various operations being conducted on the sheets.

Material units such as document sheets can be categorized as being either "flats" or "letters." In this context, a flat unit is a material unit that remains planar at the end of each processing operation—that is, the unit is not folded. A letter unit, on the other hand, is folded one or more times by some form of a folding apparatus. Conventional sheet handling systems require two separate and distinct modules to handle flats and letters, respectively. This is largely due to the fact that flats and letters are dimensionally different from each other and is especially true with regard to staging, accumulating, and collecting modules. Indeed, flats and letters are conventionally handled by two entirely separate handling systems. For material unit processing sites that conduct processing jobs on both flat and letter-type units, the deployment of separate modules and/or systems requires a large overall machine footprint and thus costly floorspace.

An apparatus that functions as a document collector, diverter and stager is disclosed U.S. Pat. No. 5,899,453, commonly assigned herewith and the contents of which are incorporated herein. The apparatus is capable of collecting sheet articles, selectively diverting or advancing the collected sheet articles, and holding or staging the advanced sheet articles until a predetermined time when they are then selectively further advanced to a downstream module such as an envelope inserter. First and second stages include transport mechanisms for advancing sheet articles through the apparatus. Each transport mechanism includes a pair of rotation members such as endless belts or chains that rotate around arrangements of rollers. Each pair of rotation members are driven independently from the other pair, so that sheet articles in each stage can be processed selectively and independently of the other stage. For instance, as sheet articles in the second stage are being advanced therefrom, sheet articles could be collecting in the first stage, or a collected stack of sheet articles could be held or staged in the first stage. In a preferred embodiment, plastic chains are provided with plastic lugs attached thereto for engaging the sheet articles. An example of a suitable lightweight chain and lug arrangement is disclosed in U.S. Pat. No. 5,806,659, commonly assigned herewith and the contents of which are incorporated herein. The sheet articles processed by the apparatus disclosed in U.S. Pat. No. 5,899,453 can be either folded or unfolded. The apparatus, however, does not provide a means for adjusting between a flats mode specifically designed to handle unfolded articles and a letters mode specifically designed to handle folded articles.

It would therefore be advantageous to provide a unitary module or apparatus that is capable of handling both flats and letters without adversely affecting the efficiency of the processing jobs to be conducted. Such an apparatus would reduce the footprint required at the processing site, and be easily adjustable or convertible between the two modes of operation, i.e., between flat and letters processing. Moreover, such an apparatus should be compatible with existing upstream and downstream modules ordinarily provided with sheet handling systems.

The present invention, as described and claimed hereinbelow, addresses these and other problems associated with the handling of different types of material units.

DISCLOSURE OF THE INVENTION

The present invention provides an apparatus and method for collecting material in two modes of operation, flats and letters, without any degradation in performance when compared to a conventional apparatus operating in only one mode. By providing the means for a minor adjustment or adjustments by the user, the apparatus can be transformed from a two-stage device, which is optimal for the folded letter mode of operation, to a one-stage device, which is optimal for the flats mode of operation. The present invention thus combines features of both flats and letters collector modules. As a result, the setup time between a letters and flats processing job is greatly reduced, and the overall footprint is optimized. In addition, costs relating to equipment, maintenance and labor are reduced.

According to one embodiment of the present invention, a collector apparatus is adapted for handling flat and letter units. The apparatus comprises a first staging area, a second staging area generally disposed downstream from the first staging area, a third staging area, and a conveying device. The first staging area comprises a first staging surface and a first stage transport assembly, and the second staging area comprises a second staging surface and a second stage transport assembly. The third staging area comprises at least a portion of the second stage transport assembly. The conveying device is adjustable between a flats mode position and a letters mode position. In the letters mode position, a first material flow path is defined through the first and second staging areas. In the flats mode position, a second material flow path is defined through the third staging area.

According to another embodiment of the present invention, the first stage transport assembly comprises a movable first endless member and the second stage transport assembly comprises a movable second endless member. Each endless member includes one or more pusher elements. The endless members are situated with respect to each other such that a pusher element of the first endless member initiates transport of a material unit through the second staging area, and in effect hands off the material unit to a pusher element of the second endless member. The pusher element of the second endless member continues the transport of the material unit through the second staging area. This function can be facilitated by having the first endless member share a common axis of rotation with the second endless member.

In effect, the third staging area of the collector apparatus is the sole staging area available when the collector apparatus has been converted into the flats mode position. The third staging area can be defined by one or more components of the first and/or second staging areas, depending on the size of the flat units to be processed by the collector apparatus. In one configuration, the third staging area is defined in part by a pusher element movable by the first stage transport assembly. In another configuration, the third staging area comprises a pusher element movable by the first stage transport assembly as well as a pusher element movable by the second stage transport assembly. In this configuration, the pusher element of the first stage transport assembly first engages a flat unit to advance that unit forward, and then hands off the flat unit to the pusher element of the second stage transport assembly. In yet another configuration, the third staging device comprises only a pusher element movable by the second stage transport assembly.

According to yet another embodiment of the present invention, the conveying device comprises a retractable first conveying assembly. The retractable first conveying assembly is extended over at least a portion of the first staging surface at the flats mode position of the conveying device, and is retracted to expose the first staging surface at the letters mode position. According to still another embodiment of the present invention, the collector apparatus comprises an input device operatively communicating with an upstream end region of the first staging area at the letters mode position, and operatively communicating with an upstream end region of the third staging area through the conveying device at the flats mode position. The input device can form a part of, or at least be in operative communication with, an upstream material unit processing device.

According to a further embodiment of the present invention, a biasing component such as a constant-force spring is used to bias the retractable first conveying assembly toward the flats mode position.

According to a yet further embodiment of the present invention, the conveying device comprises a material unit guiding component that is adjustable between the flats mode position and the letters mode position. In the letters mode position, the guiding component is disposed at a first elevation at which the guiding component is adapted to at least partially define the first material flow path. In the flats mode position, the guiding component is disposed at a second elevation that is higher than the first elevation.

According to a still further embodiment of the present invention, a material unit collector apparatus is adapted for alternately handling flat and letter units. The apparatus comprises a first staging area, a second staging area generally disposed downstream from the first staging area, and an adjustable transport assembly. The first staging area comprises a first staging surface and a first stage transport assembly, and the second staging area comprises a second staging surface and a second stage transport assembly. The adjustable transport assembly comprises a lower transport subassembly that is adjustable between a flats mode position and a letters mode position. The lower transport subassembly includes a lower conveying element that operatively engages a front rotatable element and a rear rotatable element. The front rotatable element is disposed above the first staging surface and is generally horizontally adjustable between the flats mode and letters mode positions. The rear rotatable element is disposed below the first staging surface and is generally vertically adjustable between the flats mode and letters mode positions.

According to an additional embodiment of the present invention, a material unit handling system comprises an upstream material unit processing device and a material unit collector apparatus. The material unit collector apparatus comprises a staging area that includes an upstream region and a downstream region, and a conveying device that is adjustable between a flats mode position and a letters mode position. In the letters mode position, the conveying device provides a first material flow path running from the upstream material unit processing device and through the staging area. In the flats mode position, the conveying device provides a second material flow path running from the upstream material unit processing device through the downstream region of the staging area and bypassing the upstream region of the staging area. In a further embodiment, the system comprises a downstream material unit processing device that communicates with the first material flow path in the letters mode position, and alternatively communicates with the second material flow path in the flats mode position.

According to another aspect of the present invention, a method is provided for converting a collector apparatus between a letters mode of operation and a flats mode of operation. A collector apparatus is provided that comprises a first staging area, a second staging area generally disposed downstream from the first staging area, a third staging area comprising at least a portion of the second staging area, and an adjustable conveying element. The adjustable conveying element is moved between a letters mode position and a flats mode position. The letters mode position causes sheet articles to operatively flow into the first staging area. The flats mode position causes sheet articles to operatively flow into the third staging area. Depending on which mode of operation (flats or letters) is to be implemented by the collector apparatus and whether the collector apparatus needs to be changed or reset from one mode to the other mode, the adjustable transport assembly can be set to either the letters mode position or the flats mode position. The method thus encompasses converting the collector apparatus from the letters mode to the flats mode and likewise from the flats mode to the letters mode.

The adjustable transport assembly can be set to the letters mode position by lowering a rotatable member to a lower position, moving another rotatable member to an upstream region of the first staging area, and/or retracting an endless member rotatable about the rotatable members, thereby enabling sheet articles to be transported across a first staging surface of the first staging area.

The adjustable transport assembly can be set to the flats mode position by raising the first rotatable member to an upper position, moving the second rotatable member to a downstream region of the first staging area, and/or extending the endless member over at least a portion of the first staging area.

If a conversion from one mode of operation to the other mode of operation is desired during the course of operating the collector apparatus, the steps performed for setting the adjustable transport assembly to one of the modes of operation can be alternated with the steps performed for setting the adjustable transport assembly to the other mode of operation.

According to yet another aspect of the present invention, a method is provided for transporting letter units and/or one or more stacks of letter units through a collector apparatus. A collector apparatus is provided that comprises a first staging area, a first stage transport assembly operative within the first staging area, a second staging area generally disposed downstream from the first staging area, a second stage transport assembly operative within the second staging area, a third staging area comprising at least a portion of the second stage transport assembly, and an adjustable conveying element. The adjustable conveying element is set to a position at which the first stage transport assembly can operatively engage letter units. A letter unit is caused to enter the first staging area and become engaged with the first stage transport assembly. The first stage transport assembly is caused to transport the letter unit into the second staging area and become engaged with the second stage transport assembly.

According to still another aspect of the present invention, a method is provided for transporting flat units and/or one or more stacks of flat units through a collector apparatus. A collector apparatus is provided that comprises a first staging area, a first stage transport assembly operative within the first staging area, a second staging area generally disposed downstream from the first staging area, a second stage transport assembly operative within the second staging area, a third staging area comprising at least a portion of the second stage transport assembly, and an adjustable conveying element. The adjustable conveying element is caused to transport a flat unit into the third staging area. The flat unit is caused to become engaged with the second stage transport assembly.

According to any of the methods disclosed herein for handling letter-type sheet articles, individual sheet articles and/or stacks thereof can be collected and/or staged in either of the first and second staging areas, as well as transported into and out from either staging area. For instance, sheet articles can be sequentially introduced into the first staging area and collected into a first stack therein. The first stack can then be transferred into the second staging area, and staged or held in the second staging area for a predetermined period of time. A second stack can then be collected into the first staging area, while the first stack is either staged in the second staging area or being transported out from the second staging area. Once a predetermined number of sheet articles have been collected into the second stack in the first staging area, the second stack can be transferred into the second staging area after the second staging area has been cleared of the first stack.

If, on the other hand, the collector apparatus has been set to handle flat-type sheet articles, all such sheet articles will be processed in a single staging area, which is referred to herein as the third staging area since this stage does not necessarily directly correspond to either the first of the second staging areas. Such processing likewise can encompass collecting, staging, and transporting one or more sheet articles in this third staging area.

It is therefore an object of the present invention to provide a collector apparatus and method capable of handling both flat and letter-type material units.

It is another object of the present invention to provide a collector apparatus and method capable of being easily adjusted between flats and letters modes of operation.

It is yet another object of the present invention to provide a collector apparatus and method capable of operating as either a single-stage or multi-stage apparatus.

These objects are achieved, in whole or in part, by the apparatus and method of the invention described herein.

Some of the objects of the invention having been stated hereinabove, other objects will become evident as the description proceeds when taken in connection with the accompanying drawings as best described hereinbelow.

DETAILED DESCRIPTION OF THE INVENTION

Figure 1:
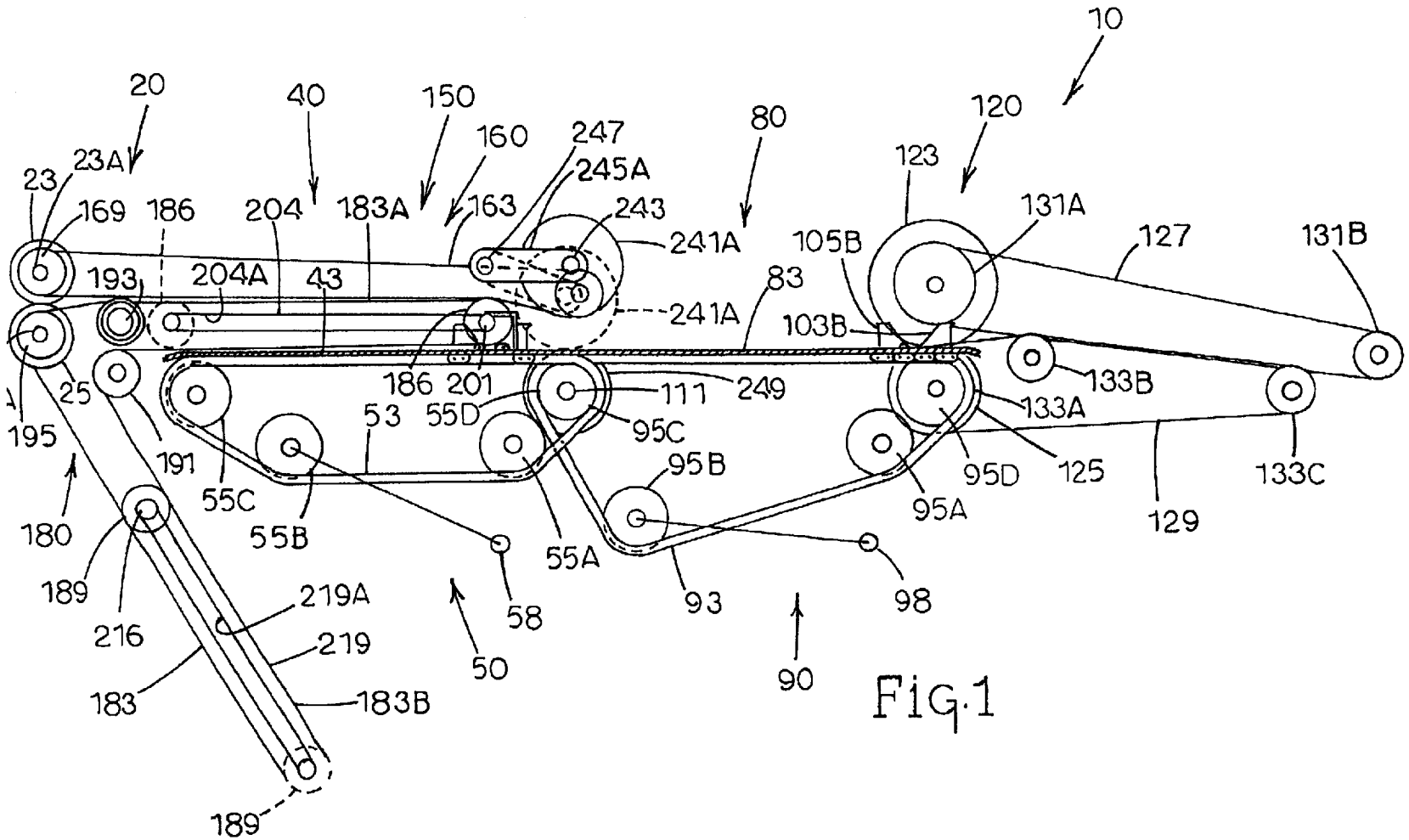
FIG. 1 is a side elevation view of a collector apparatus provided according to the present invention.

Referring now to FIG. 1, a combined flats and letters collector apparatus, generally designated 10, is illustrated in accordance with the present invention. Broadly stated, collector apparatus 10 includes a suitable input device, generally designated 20; a first staging area, generally designated 40; a second staging area, generally designated 80; an exit device, generally designated 120; and an adjustable transport assembly, generally designated 150. Although not specifically shown for clarity, it will be understood by persons skilled in the art that collector apparatus 10 includes a suitable form of a main structural frame with respect to which the above-described assemblies and areas are disposed and arranged.

As will be further understood but not specifically shown, collector apparatus 10 preferably includes (or communicates with) a suitable form of electronic control circuit that coordinates and controls the respective operations of one or more assemblies or devices associated with collector apparatus 10 and the job processing system in which collector apparatus 10 operates. The control functions are typically implemented through the use of electrical conduits adapted for sending and receiving signals to and from the control circuit and various locations or devices of collector apparatus 10. Moreover, the control methodology typically involves the use of various sensors designed to monitor the positions of the devices associated with collector apparatus 10 and provide feedback signals to the control circuit, as well as sensors designed to monitor the position of material units (e.g., sheet articles) as they reach or pass various points along the course of collector apparatus 10. Examples of the use of optical-type sensors in the environment of material unit handling are provided in U.S. patent application Ser. No. 09/508,876, commonly owned herewith, and the disclosure of which is incorporated herein by reference.

As described in more detail hereinbelow, collector apparatus 10 is selectively operable in one of two modes, the first mode being the letters mode and the second mode being the flats mode. In the letters mode, at least two staging areas are defined and utilized, while in the flats mode one staging area is utilized. For many sizes of flat units, the sole staging area utilized is different in definition from either of the two staging areas associated with the letters mode. It will also become readily evident that collector apparatus 10 is adjustable between the flats and letters modes.

In the exemplary embodiment shown in FIG. 1, input device 20 includes an upper roller 23 and a lower roller 25 that cooperatively form a nip therebetween, and through which material units to be processed by collector apparatus 10 are driven. Upper roller 23 rotates about an upper axis (e.g., an axle) 23A and lower roller 25 rotates about a lower axis 25A. In the present example, upper axis 23A is connected to a motor (not shown) such that upper roller 23 drives lower roller 25. In as much as the module immediately upstream of collector apparatus 10 can be a folder apparatus (not shown), input device 20 could form a part of such folder apparatus. For example, input device 20 might constitute the output device of the folder apparatus. An example of a folder apparatus is disclosed in U.S. Pat. No. 6,247,691, commonly owned herewith.

First staging area 40 includes a first staging surface 43 (or at least a portion thereof) on or over which letters are transported. First staging area 40 also includes a first stage transport assembly, generally designated 50, of which a first conveying member 53 forms a part. First conveying member 53 preferably constitutes one or more endless elements, such as belts or chains, that engage several rotatable elements 55A–55D such as rollers and/or sprockets. At least one of rotatable elements 55A–55D constitutes the driving element, while other rotatable elements 55A–55D can be idler elements. In the present embodiment, the driving element is rotatable element 55A and is powered by a motor 57 (see FIG. 8) through a suitable transmission mechanism (not specifically shown). A chain tensioning device 58 operatively engages at least one of the driven rotatable elements (rotatable element 55B in the present example) to maintain and adjust the proper amount of tension in first conveying member 53. It will be understood that first conveying member 53 can constitute one or more such endless elements that are spaced over the width of first staging area 40, when considered from the perspective of the side view of FIG. 1 (i.e., when considered along the direction perpendicular to the drawing sheet of FIG. 1). Preferably, first conveying member 53 comprises a pair of spaced endless members. A similar arrangement is disclosed in commonly assigned U.S. Pat. No. 5,899,453.

Figure 2:
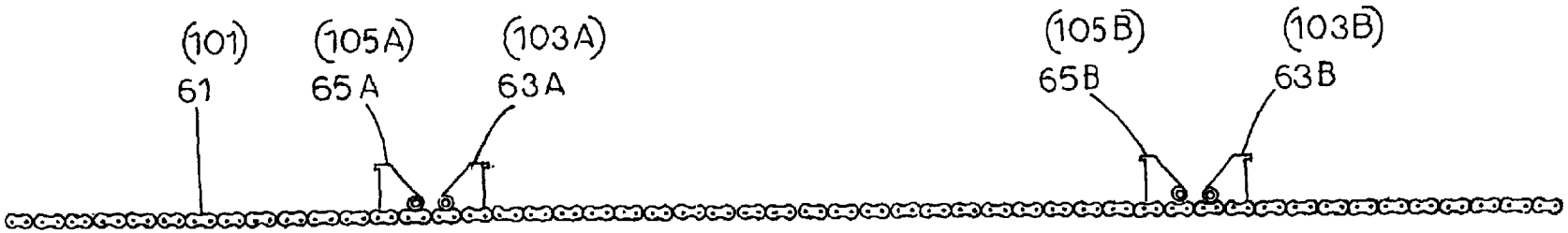
FIG. 2 is a side elevation view of a chain including pushing and registering elements, which is suitable for use in the collector apparatus illustrated in FIG. 1.

FIG. 2 illustrates one preferred embodiment of a length of a suitable endless element (or one of two or more endless elements) constituting first conveying member 53, in which a plastic chain 61 is provided. It will be understood, however, that a material other than a plastic could be selected for the endless element. One or more suitable pusher pins 63A and 63B or other types of sheet-driving elements are attached to chain 61. In addition, one or more suitable stop pins 65A and 65B or other types of registration elements are attached to chain 61. Stop pins 65A and 65B are preferably spaced along the length of chain 61 so as to register a material unit or set of material units (e.g., folded letters) having first been transported into first staging area 40. It will be understood, however, that the registration elements could be provided in other forms that are not connected to chain 61 in this manner. One alternative example is to provide retractable registration elements that are suitably positioned and supported by the frame of collection apparatus 10. Pusher pins 63A and 63B and stop pins 65A and 65B move with first conveying member 53, and thus rotate along the cyclical path defined by first conveying member 53. In this manner, pusher pins 63A and 63B and stop pins 65A and 65B are "active" when protruding above the plane defined by first staging surface 43 (see, e.g., FIGS. 1 and 6A). When any given set of pusher pins 63A and 63B and stop pins 65A and 65B rotate with first conveying member 53 around rotatable element 55D, pusher pins 63A and 63B and stop pins 65A and 65B move below the plane of first staging surface 43 and are, in effect, "retracted" or "inactive" until rotating around rotatable element 55C to return to the upstream end of first staging area 40. As best shown in the top views of FIGS. 3, 4C, and 5C, longitudinal openings 68A and 68B are provided in first staging surface 43 through which pusher pins 63A and 63B and stop pins 65A and 65B can protrude above first staging surface 43 in order to carry out their respective functions on material units.

Referring back to FIG. 1, second staging area 80 is similar in arrangement to first staging area 40. Second staging area 80 thus includes a second staging surface 83 (or at least a portion thereof) on or over which letters or flats are transported. Second staging surface 83 can be contiguously integrated with first staging surface 43 such that first staging surface 43 and second staging surface 83 are co-planar, or second staging surface 83 can be provided as a physically separate surface. Second staging area 80 likewise includes a second stage transport assembly, generally designated 90, of which a second conveying member 93 forms a part. Second conveying member 93 also preferably constitutes one or more endless elements, such as belts or chains, that engage several rotatable elements 95A–95D such as rollers and/or sprockets. At least one of rotatable elements 95A–95D constitutes the driving element, while other rotatable elements 95A–95D can be idler elements. In the present embodiment, the driving element is rotatable element 95A and is powered by a motor 97 (see FIG. 8) through a suitable transmission mechanism (not specifically shown). A tensioning device 98 operatively engages at least one of the driven rotatable elements (rotatable element 95B in the present example) to maintain and adjust the proper amount of tension in second conveying member 93. As in the case of first conveying member 53, it will be understood that second conveying member 93 can constitute one or more such endless elements that are spaced over the width of second staging area 80, again when considered from the perspective of the side view of FIG. 1. As in the case of first conveying member 53, it is preferred that second conveying member 93 comprise a pair of spaced endless members. A similar arrangement is disclosed in commonly assigned U.S. Pat. No. 5,899,453.

Figure 4A:
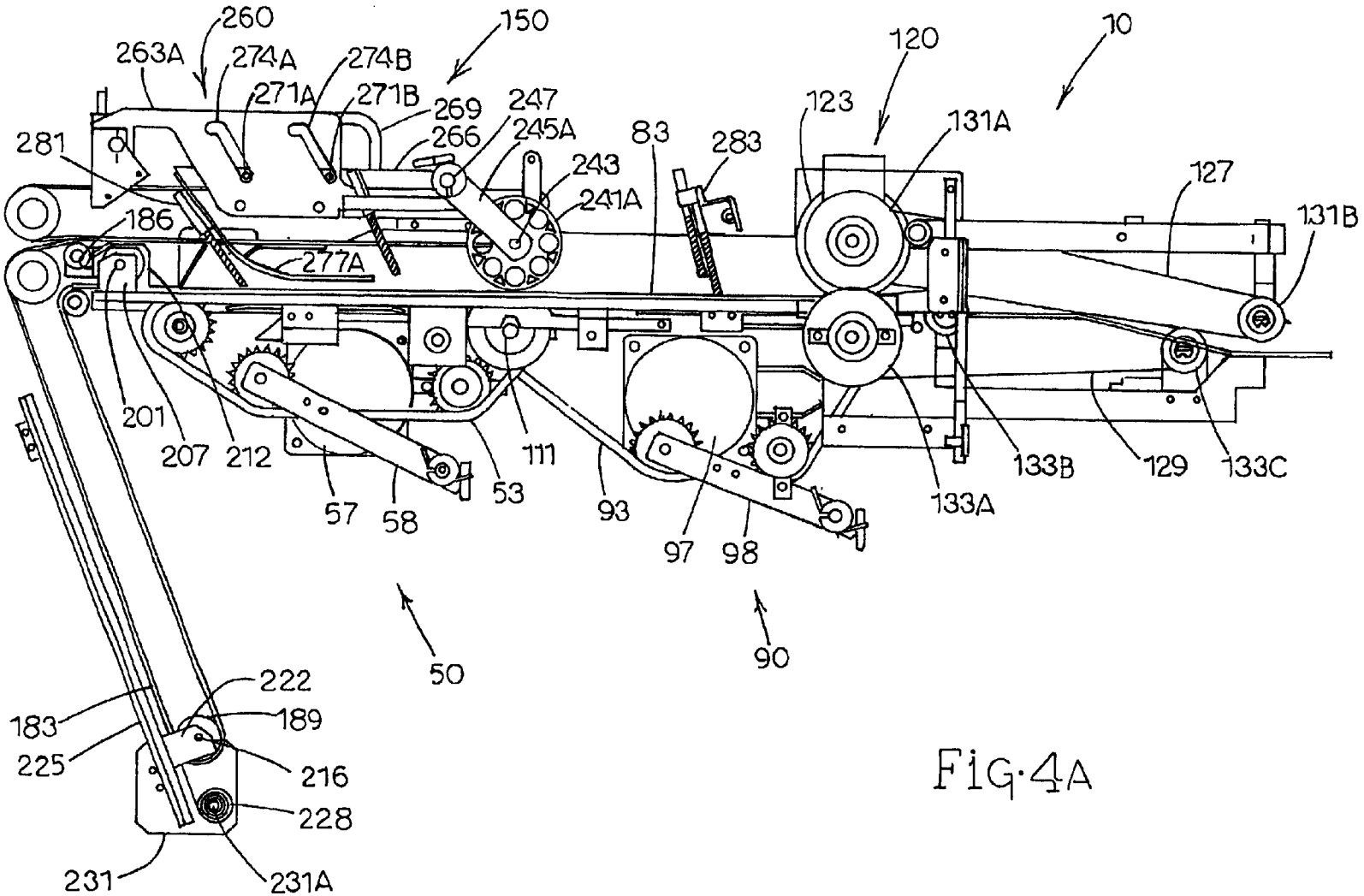
FIG. 4A is a side elevation view of the collector apparatus illustrated in FIG. 1 in the letters mode position.

One preferred embodiment of a length of a suitable endless element (or one of two or more endless elements) constituting second conveying member 93 is given by referring back to FIG. 2, wherein analogous reference numerals corresponding to second conveying member 93 are designated parenthetically. Accordingly, second conveying member 93 can include a plastic chain 101 to which one or more pusher pins 103A and 103B and stop pins 105A and 105B are attached. It will be understood, however, that the respective lengths of chains 61 and 101 of first and second conveying members 53 and 93 are not necessarily the same, nor are the respective quantities of pusher pins 63A and 63B and stop pins 65A and 65B necessarily the same as pusher pins 103A and 103B and stop pins 105A and 105B. As shown in FIGS. 4C and 5C, longitudinal openings 108A and 108B are provided in second staging surface 83 through which pusher pins 103A and 103B and stop pins 105A and 105B protrude.

As indicated hereinabove, a suitable construction for the endless elements constituting first and second conveying members 53 and 93 is disclosed in commonly assigned U.S. Pat. No. 5,806,659. U.S. Pat. No. 5,806,659 discloses as one embodiment a plastic chain comprising a series of substantially parallel rollers maintained in a spaced-apart relationship by a series of interconnected link plates. The link plates are pivotally attached to the opposing ends of the rollers and on each lateral side of the rollers to form pairs of opposing link plates interconnecting adjacently disposed rollers. Lugs are provided in the form of opposing plates, and serve as either pusher pins or stop pins such as shown in FIG. 2 of the present invention. The lugs are attached to the chain either by being connected to some of the link plates or by being connected directly to the rollers in the place of certain link plates. As will be appreciated by those skilled in the art, each lug, whether functioning as a pusher pin or a stop pin, can be repositioned at different locations in relation to the staging areas. This is one method by which chains, when utilized in first and second conveying members 53 and 93 of the present invention, can be modified to accommodate different sizes of sheet articles such as flat and letter units. In other cases, however, such accommodation can be adequately effected by adjusting the respective speeds of first and second conveying members 53 and 93. Homing sensors can be provided to monitor the positions of one or more of the pusher and/or stop pins based on form length and for optimal performance.

In some uses of the present invention, it is contemplated that the respective positions of pusher pins 63A and/or 63B and stop pins 65A and/or 65B of first conveying member 53 could be adjusted to accommodate changes in form length of letter units, but that the respective positions of pusher pins 103A and 103B and stop pins 105A and/or 105B of second conveying member 93 would not ordinarily be adjusted for either letter units or flat units. That is, the "home" position of the second stage of collector apparatus 10 will always remain the same. In FIG. 1, for example, the home position corresponds to the position of stop pin 105B at or near the rotational axes of upper and lower exit rollers 123 and 125. This illustrated home position has been found to be suitable for all typical jobs to be processed using collector apparatus 10.

Figure 3:
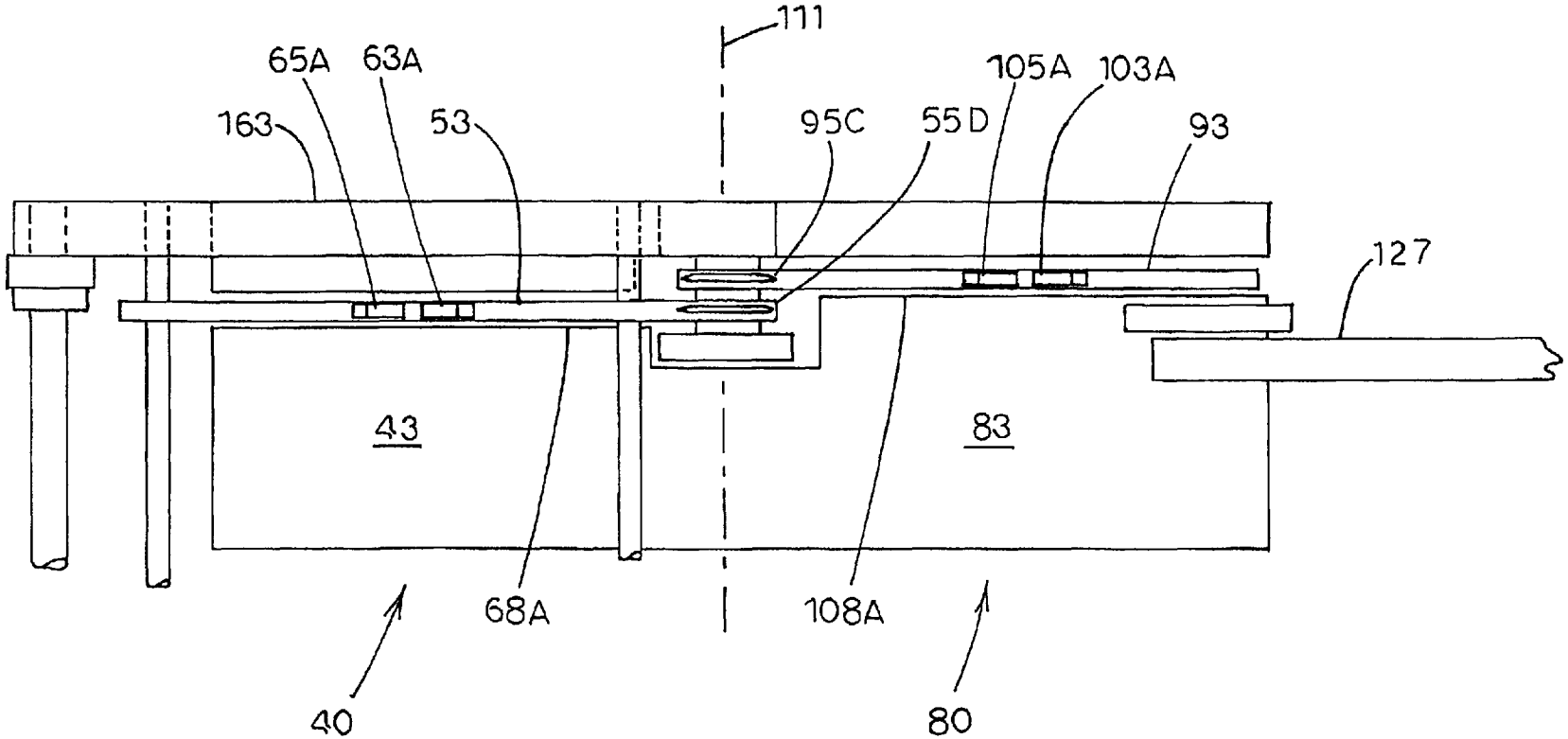
FIG. 3 is a top plan view of a section of the collector apparatus illustrated in FIG. 1.

The respective positions of first conveying member 53 and second conveying member 93 are illustrated in FIG. 3, which shows certain details of longitudinal half section of collector apparatus 10. It can be seen, both from the side view perspective of FIG. 1 and from the top view of FIG. 3, that first conveying member 53 is laterally adjacent to second conveying member 93 at the interfacial region of first and second staging areas 40 and 80. This arrangement is advantageous when first and second conveyor members 53 and 93 are provided in the form illustrated in FIG. 2, i.e., as endless elements 61 and 101 with one or more sets of pusher pins 63 and 103 and stop pins 65 and 105. The arrangement is particularly advantageous when collector apparatus 10 is operating in the letters mode, during which letters are first transported into first staging area 40 and thereafter transported into second staging area 80. As pusher pin 63A (or pair of widthwise spaced pusher pins 63A) of first conveying member 53 begins to transport a letter (or set or letters) from first staging area 40 into second staging area 80, pusher pin 63A of first conveying member 53 in effect passes control of the letter over to pusher pin 103A of second conveying member 93 in a smoothly executed operation.

Subsequently, pusher pin 63A of first conveying member 53 moves below the plane of first staging surface 43 while pusher pin 103A of second conveying member 93 either continues to transport the letter across second staging surface 83 or otherwise holds the letter for a period of time (depending on the particular synchronized sequence of upstream and/or downstream operations being performed at the particular time). For this arrangement to be executed effectively, second conveying member 93 might be required to operate (and preferably does operate) at a faster speed than first conveying member 53, such that second conveying member 93 accelerates the letter to prevent pusher pin 63A of first conveying member 53 from possibly damaging the letter as pusher pin 63A moves below the plane of first staging surface 43. As further shown in FIG. 3, at the interfacial region between first and second staging areas 40 and 80, rotatable element 55D of first stage transport assembly 50 and rotatable element 95C of second stage transport assembly 90 can rotate about the same axis 111 (e.g., utilize the same axle or shaft). In this latter case, however, axis 111 cannot be the driving axis if first and second conveyor members 53 and 93 are to operate at different speeds.

Referring back to the exemplary embodiment illustrated in FIG. 1, exit device 120 of collector apparatus 10 includes a pair of nip rollers such as upper and lower exit rollers 123 and 125, respectively. If more space is required between collector apparatus 10 and whatever module (not shown) is provided immediately downstream from collector apparatus 10, a pair of endless members such as upper and lower exit transport belts 127 and 129 can be provided. Upper exit transport belt 127 is wrapped around an upper rotatable element 131A (which can rotate about the same axis as upper exit roller 123 if desired) as well as other upper rollers such as roller 131B, while lower exit transport belt 129 is wrapped around a lower rotatable element 133A (which can rotate about the same axis as lower exit roller 125 if desired) as well as other lower rollers 133B and 133C.

Figure 5A:
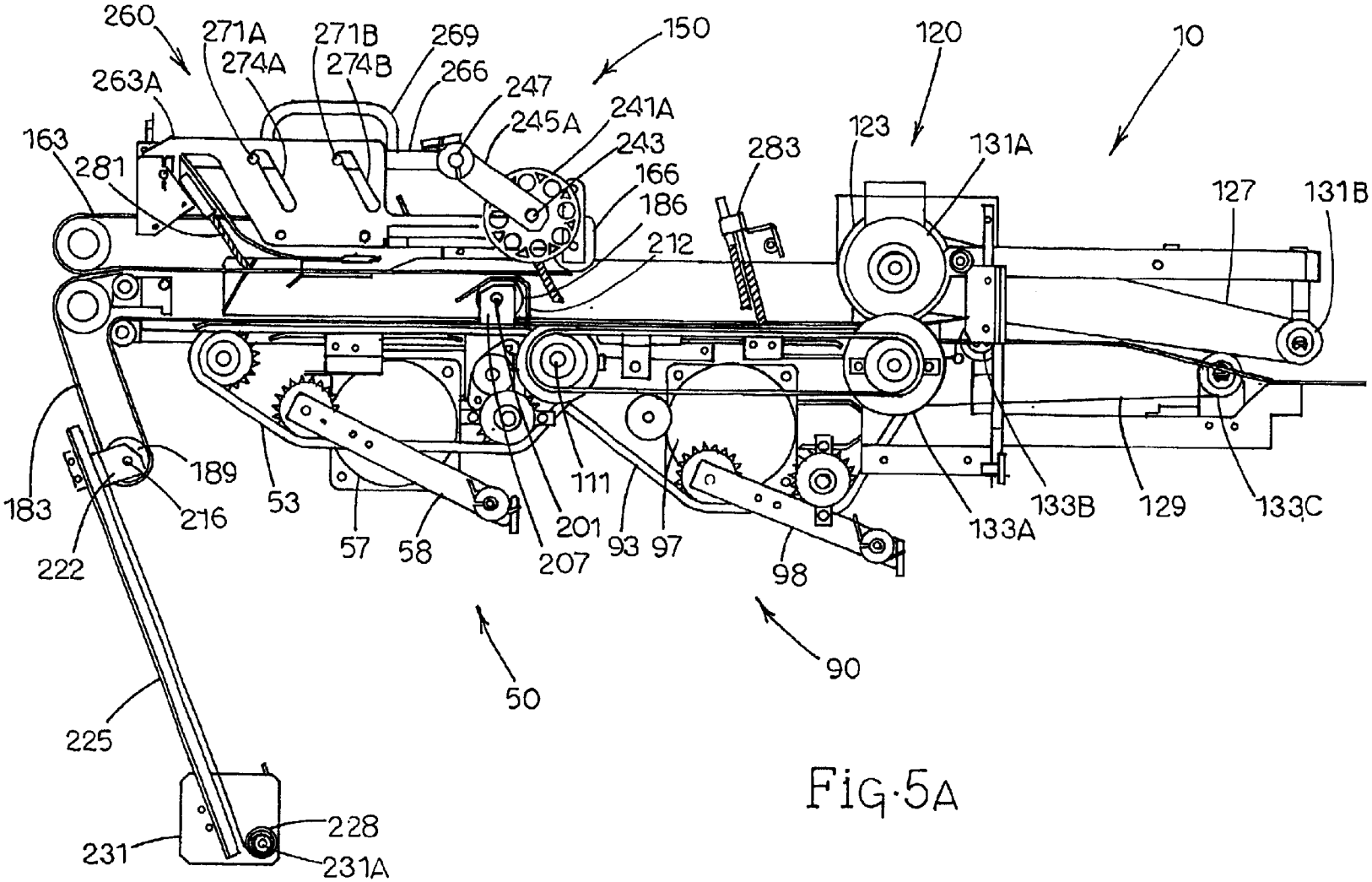
FIG. 5A is a side elevation view of the collector apparatus illustrated in FIG. 1 in the flats mode position.

In FIG. 1, adjustable transport assembly 150 of collector apparatus 10 is shown in both flats and letters mode positions, with phantom lines corresponding to the letters mode position. Adjustable transport assembly 150 comprises an upper transport subassembly, generally designated 160, and a lower transport subassembly, generally designated 180. Upper transport subassembly 160 comprises an upper conveying device that includes an upper endless belt 163. Upper endless belt 163 is wrapped around a front rotatable element such as an upper nose roller 166 (as best shown in FIG. 5A) and a rear rotatable element 169 (which can rotate about the same axis as upper roller 23 of input device 20 if desired). In the present embodiment, upper transport subassembly 160 remains fixed in the position shown in FIG. 1, while lower transport subassembly 180 is adjustable in a manner described in more detail hereinbelow.

Lower transport subassembly 180 comprises a lower conveying device that includes a lower endless belt 183. Lower endless belt 183 is wrapped around a rotatable element such as a lower nose roller 186 and an extension take-up roller 189. Lower endless belt 183 also engages additional rollers 191, 193 and 195. Rotatable element 195 can be positioned to rotate about the same axis as lower roller 25 of input device 20 if desired. In the present embodiment, lower endless belt 183 is generally longer than upper endless belt 163, as lower endless belt 183 must be able to accommodate the physical adjustment of adjustable transport assembly 150 between the flats and letters modes. At the same time, however, lower endless belt 183 must not appreciably add to the space requirements of collector apparatus 10. Hence, in the embodiment illustrated in FIG. 1, lower endless belt 183 extends along directions having both horizontal and vertical (or near vertical) components. Additionally, a front section 183A of lower endless belt 183 is generally situated above the plane of first staging surface 43, while a rear section 183B of lower endless belt 183 is generally situated below the plane of first staging surface 43. Front section 183A of lower endless belt 183 generally extends along a horizontal direction. Rear section 183B of lower endless belt 183 generally extends along a vertical direction although, as shown in FIG. 1, can extend in a resultant direction that includes both horizontal and vertical components.

Lower nose roller 186 rotates about an axis 201 (e.g., an axle or shaft), and is adjustable between a first position at the downstream end region of first staging area 40 corresponding to the flats mode of operation (as indicated by solid lines in FIG. 1) and a second position at the upstream end region of first staging area 40 corresponding to the letters mode of operation (as indicated by phantom lines in FIG. 1). For this purpose, axis 201 of lower nose roller 186 is slidably supported in a slot 204A provided by an upper lateral bracket 204 (it being understood that the other end of axis 201 on the other lateral side of collector apparatus 10 can be similarly supported by an additional upper lateral bracket 204). Alternatively, as shown in FIGS. 4A and 5A, lower nose roller 186 and its axis 201 can be supported in another bracket 207 that itself is slidable along slots formed in or through first staging surface 43. These slots could be provided as longitudinal openings 68A and 68B (see FIGS. 4C and 5C) or could be separate openings. Lower transport subassembly 180 can also include a vertically-oriented back stop 212 (see FIGS. 4A and 5A) that is movable with lower nose roller 186 to establish the rear or upstream boundary of either first staging area 40 (in the letters mode) or second staging area 80 (in the flats mode).

Take-up roller 189 rotates about an axis 216 (e.g., an axle or shaft), and is adjustable between a first position indicated by solid lines in FIG. 1 corresponding to the flats mode of operation and a second, lower position indicated by phantom lines in FIG. 1 corresponding to the letters mode of operation. For this purpose, axis 216 of take-up roller 189 is slidably supported in a slot 219A provided by a lower lateral bracket 219 (it being understood that the other end of axis 216 on the other side of collector apparatus 10 can be similarly supported by an additional lower lateral bracket 219). Alternatively, as shown in FIGS. 4A, 4B, 5A and 5B, take-up roller 189 and its axis 216 can be supported in another bracket 222 that itself is slidable with respect to a slide rail 225. Preferably, a constant-force spring 228 such as the coiled type shown in FIG. 4A Is coiled around a pin 231A attached to a bracket 231 and to bracket 222 so that adjustment of the lower transport subassembly 180 is effected under a constant-force bias. Take-up roller 189 moves between the flats and letters modes in direct correspondence to the movement of lower nose roller 186 between these two modes, such that take-up roller 189 takes up any slack that develops in lower endless belt 183 during adjustment, thereby maintaining the proper tension and operation of lower endless belt 183 in each mode.

Referring to FIGS. 1 and 5A–5C, adjustable transport assembly 150 can further include a one or more pressure rollers 241A and 241B situated generally above the interfacial region of first and second staging areas 40 and 80. Preferably, pressure rollers 241A and 241B are constructed of an elastic, deformable material. Pressure rollers 241A and 241B rotate about one or more axles 243 that can be supported by respective arms 245A and 245B. In addition, arms 245A and 245B can be pivotally supported by one or more pivot members 247 (e.g., a pin or axle) such that pressure rollers 241A and 241B can be rotatably adjusted about pivot member 247. Pressure rollers 241A and 241B are adjustable between the flats mode of operation (as indicated by solid lines in FIG. 1) and the letters mode of operation (as indicated by phantom lines in FIG. 1). In the flats mode, pressure rollers 241A and 241B are inactive and elevated above first and second staging surfaces 40 and 80. In the letters mode, pressure rollers 241A and 241B are lowered (which can include being pivoted about pivot member 247) into contact either with one of first and second staging surfaces 40 or 80 or with corresponding rollers 249 provided on axis 111 (see FIG. 1). In this manner, pressure rollers 241A and 241B assist first conveying member 53 and/or second conveying member 93 in transporting letters-type material units through first and second staging areas 40 and 80, by suitably bearing down on the material units as they pass into second staging area 80.

Adjustable transport assembly 150 can be moved either manually or automatically. Conventional means for automating adjustable transport assembly 150, such as through the use of suitable actuators, linkages, sensors, controllers, and other structural and/or electronic components, are generally understood in fields of automated machinery.

The method of operation of collector apparatus 10 while in letters mode will now be described with reference being made primarily to FIG. 1. Prior to the processing of letters-type material units, adjustable transport assembly 150 is positioned into the letters mode. Chief among the adjustments made to adjustable transport assembly 150 is that of lower transport subassembly 180. That is, lower transport subassembly 180 is adjusted such that lower nose roller 186 and take-up roller 189 are moved into their respective retracted positions, as indicated by the phantom lines in FIG. 1. In this retracted position, first staging area 40 is available for receiving letters from input device 20. The term "letters" as used herein refers to either one letter or a set of letters. That is, collector apparatus 10 is capable of transporting single letters or two or more letters together as a stack through input device 20, first and second staging areas 40 and 80, and exit device 120. Similarly, collector apparatus 10 is capable of handling single flats or a stack of flats.

Letters are driven between upper roller 23 and lower roller 25 of input device 20 into first staging area 40. Depending on the precise arrangement and interrelation of components in the embodiment shown in FIG. 1, letters might or might not be driven for a short distance, prior to entry into first staging area 40, between upper endless belt 163 of upper transport subassembly 160 and lower endless belt 183 of lower transport subassembly 180. In either case, the rotation of first conveying member 53 is synchronized with that of input device 20 such that the leading edges of the letters will encounter one of stop pins 65A and 65B of first conveying member 53 (see FIG. 2) and be stopped and registered thereby, upon entry of the letters into first staging area 40. At this point, depending on the requirements of the particular processing job being executed and of the downstream and/or upstream processes occurring, the letters can be held or "staged" for a period of time in first staging area 40 prior to further transport through collector apparatus 10 for the purpose of synchronizing upstream and/or downstream operations. First conveying member 53 does not rotate during such a staging period. Alternatively, pusher elements of known design could be provided that retract below first staging surface 43 in such a way that first conveying member 53 can continue to rotate without actually contacting the letters residing in first staging area 40.

Eventually, first conveying member 53 is activated to transport the letters from first staging area 40 into second staging area 80. This is accomplished by rotating first conveying member 53 such that one or more of its pusher pins 63A or 63B engages the trailing edge or edges of the letter or letters residing in first staging area 40 and pushes the letter or letters into second staging area 80. One or more of stop pins 105A or 105B of second conveying member 93 (see FIG. 2) is positioned such that the letters will be registered against stop pin 105A or 105B as the letters enter second staging area 80. Additionally, the rotation of first conveying member 53 is synchronized with that of second conveying member 93 such that, when the letters have been transported in this manner far enough into second staging area 80, control over the letters will pass from pusher pin 63A or 63B of first conveying member 53 to pusher pin 103A or 103B of second conveying member 93. Pusher pin 103A or 103B of second conveying member 93 then accelerates the letter far enough into second staging area 80 so as to provide clearance for pusher pin 63A or 63B of first conveying member 53 to travel below the plane of first staging surface 43 without damaging the letters. As described hereinabove, the transition of the letters from first staging area 40 to second staging area 80 can be assisted by the downward bearing force provided by pressure rollers 241A and 241B which, in the letters mode, assume the position shown by the phantom lines in FIG. 1. As in the case of first staging area 40, at this point, the letters can be staged in second staging area 80 for a period of time prior to further transport through collector apparatus 10 for the purpose of synchronizing with upstream and/or downstream operations. Subsequently, the letters are driven out from second staging area 80 by passing between upper roller 123 and lower roller 125 of exit device 120. The exit operation can also entail transporting the letters between upper exit transport belt 127 and lower exit transport belt 129 of exit device 120, if these latter components are provided.

Figure 6A:
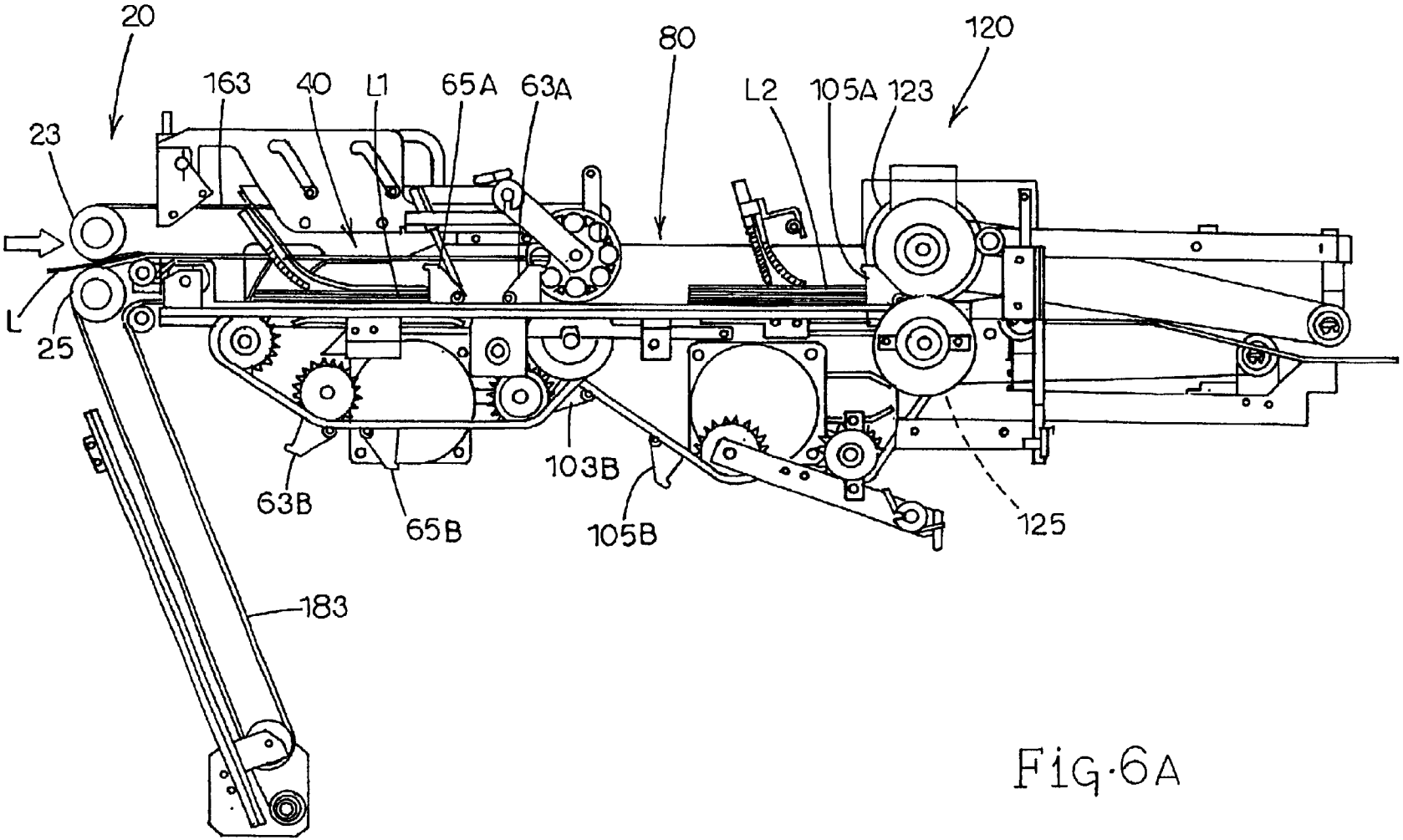
FIG. 6A Is a side elevation view of the collector apparatus illustrated in FIG. 4A wherein each stage of the apparatus has a stack of sheets registered therein and further showing the flow of a sheet article into the apparatus.
Figure 6B:
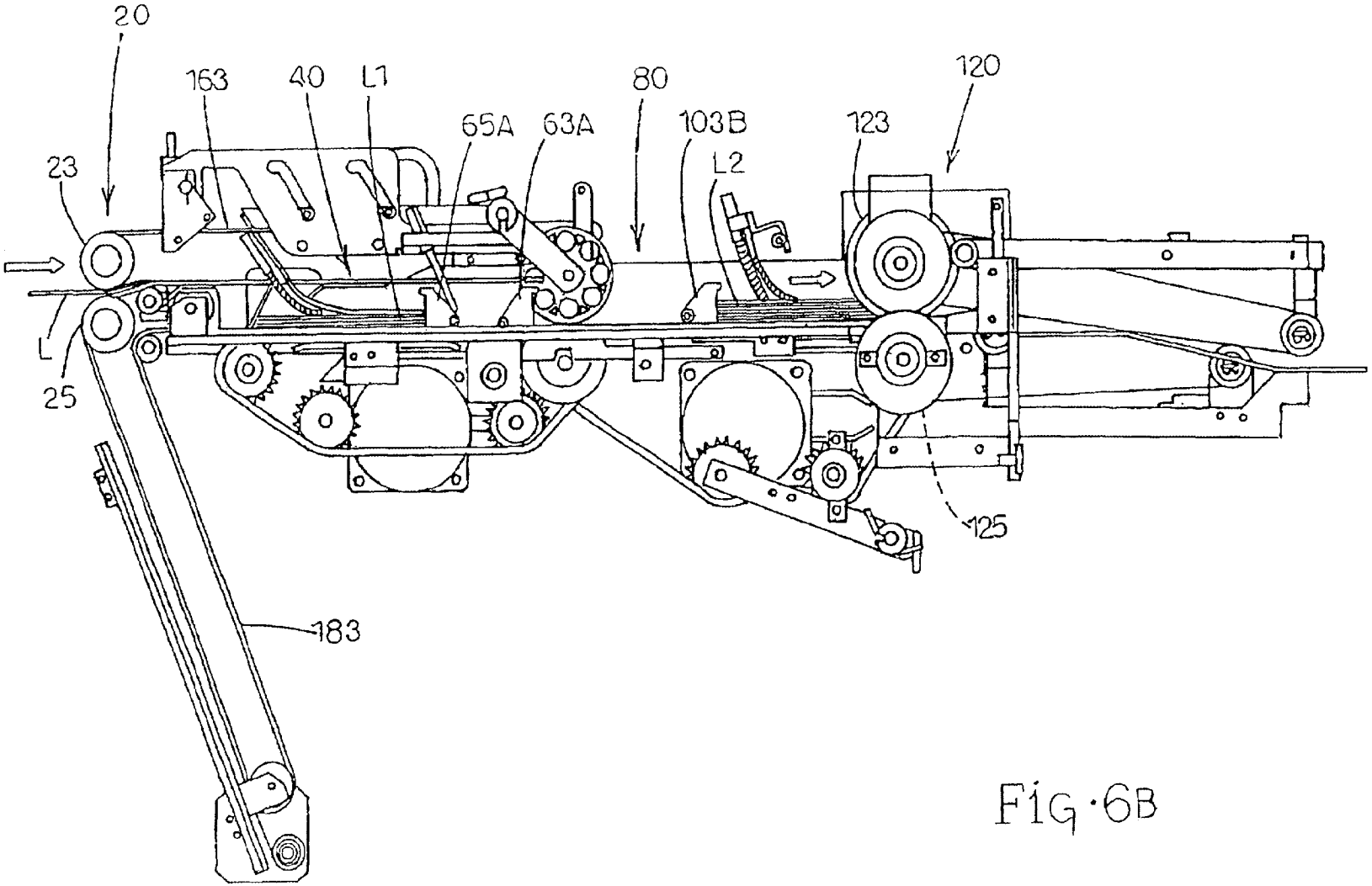
FIG. 6B is a side elevation view of the collector apparatus illustrated in FIG. 6A wherein the stack of sheets in the second stage is being transported out from the apparatus.
Figure 6C:
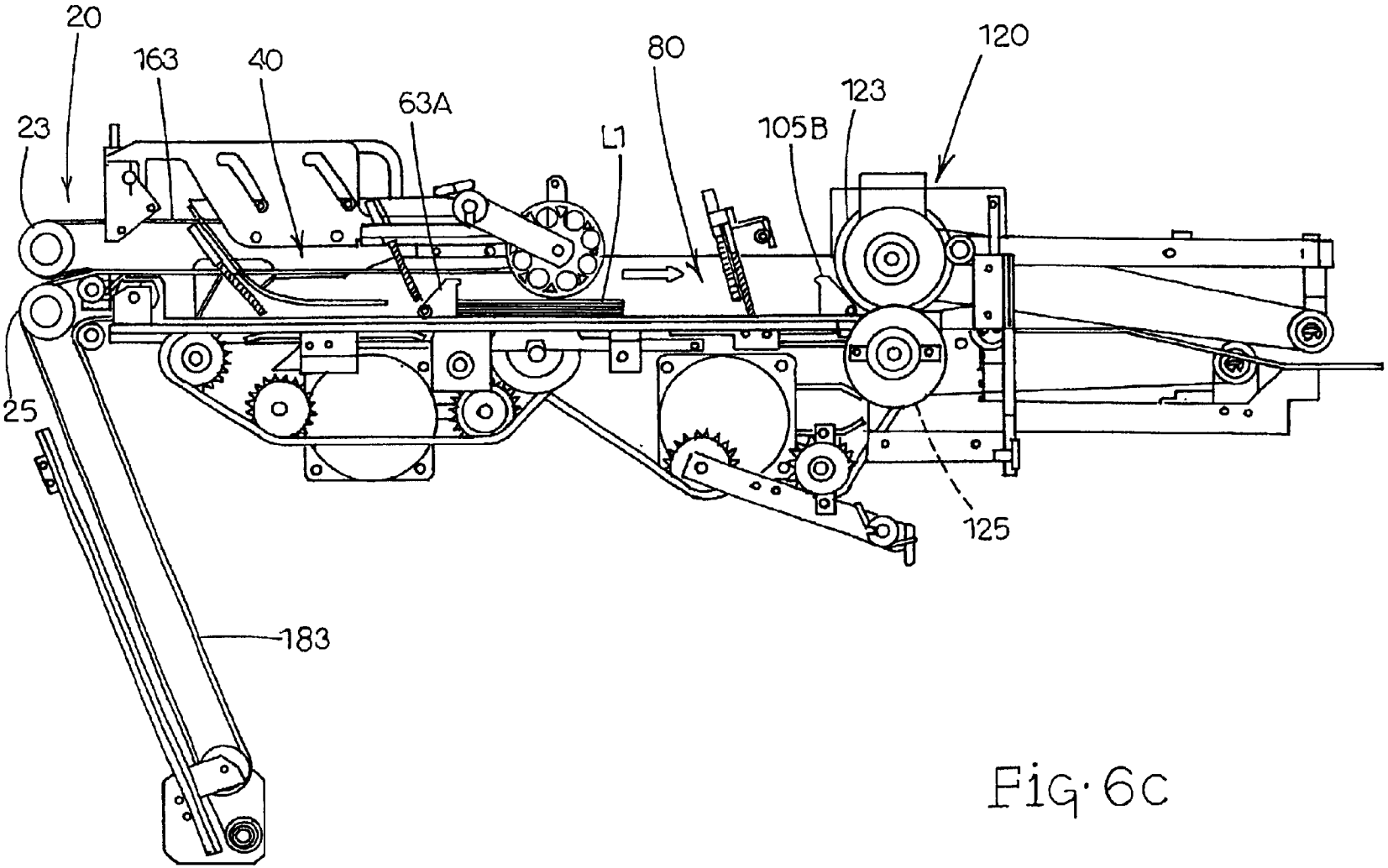
FIG. 6C is a side elevation view of the collector apparatus illustrated in FIG. 6A wherein the stack of sheets in the first stage is being transferred into the second stage.

Referring to FIGS. 6A–6C, additional examples of the method of operation of collector apparatus 10 while in letters mode are illustrated. In FIG. 6A, a single letter L is driven between upper roller 23 and lower roller 25 of input device 20 into first staging area 40, thereby resulting in a stack of letters L1 being collected in first staging area 40. Stack of letters L1 is maintained in front end registration by means of stop pin (or pair of stop pins) 65A. At the same time, another stack of letters L2, having previously been transferred through input device 20 and first staging area 40 in the manner described hereinabove, is being staged in second staging area 80 and is held in front end registration by means of stop pin (or pair of stop pins) 105A. Stack of letters L2 can be staged in second staging area 80 until it is desirable to advance stack L2 out from second staging area 80 to an appropriate downstream location. Similarly, once stack 12 has exited second staging area 80 and second staging area 80 is thus empty, stack of letters Li can be transferred into second staging area 80 from first staging area 40.

In FIG. 6B, a stack of letters L2 is being advanced in a downstream direction out from second staging area 80 by the urging of pusher pin (or pair of pusher pins) 103B. Thus, stack L2 eventually is engaged by upper roller 123 and lower roller 125 of exit device 120 for subsequent downstream transport. This is occurring while single letters L are driven through input device 20 and collected into a stack of letters L1 in first staging area 40.

In FIG. 6C, stack L1 is being transferred into second staging area 80 from first staging area 40 under the influence of pusher pins 63A. Stop pins 105B of second staging area 80 are ready to receive and register the front end of stack L1 upon its arrival in second staging area 80.

It thus can be seen that, in letters mode, first staging area 40 is defined at least in part by whichever pusher pin 63A or 63B and whichever stop pin 65A or 65B engage a letter or stack of letters. Additionally, second staging area 80 is defined at least in part by whichever pusher pin 103A or 103B and whichever stop pin 105A or 105B engage a letter or stack of letters.

Figure 7A:
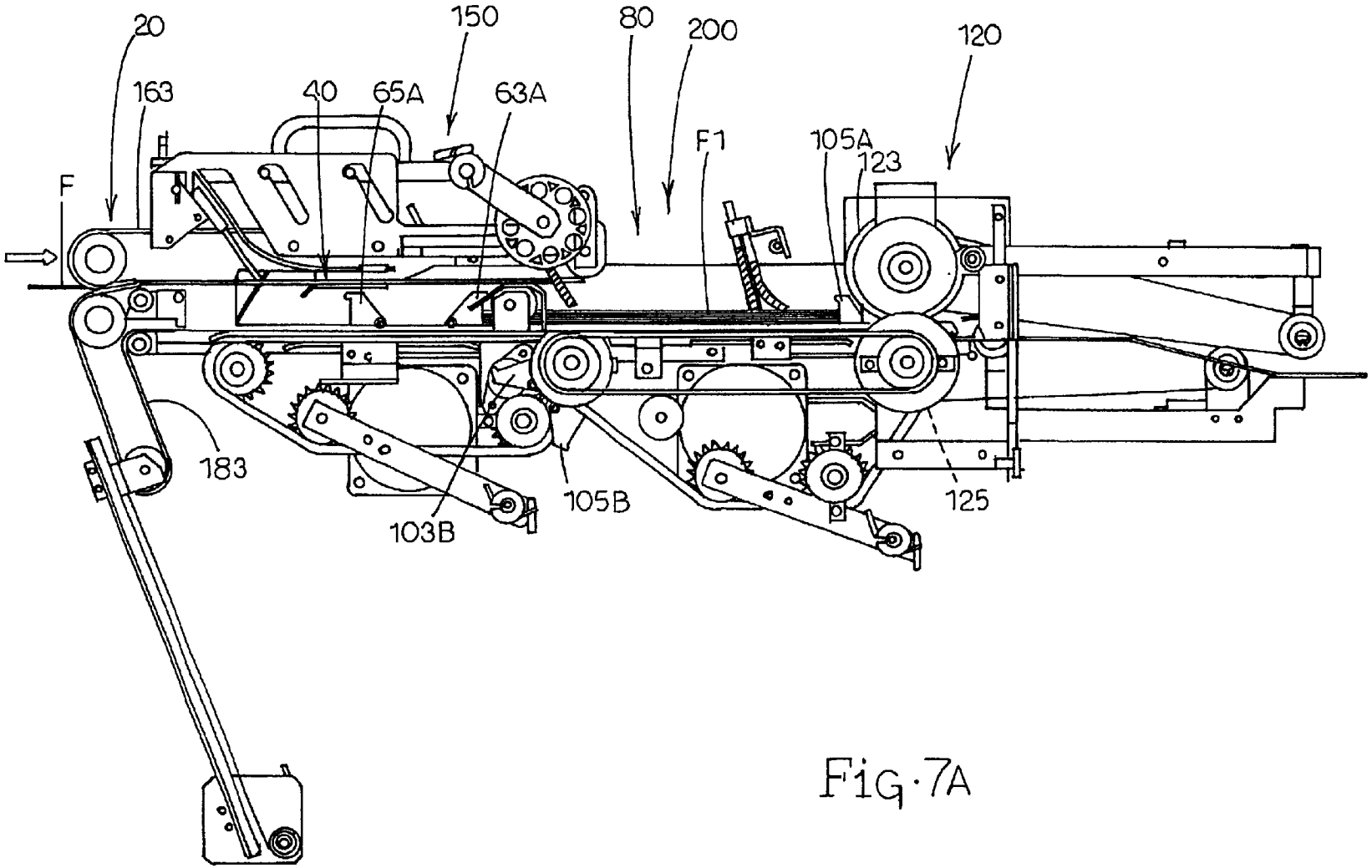
FIG. 7A is a side elevation view of the collector apparatus illustrated in FIG. 5A wherein a stack of sheets is registered in the second stage of the apparatus.
Figure 7B:
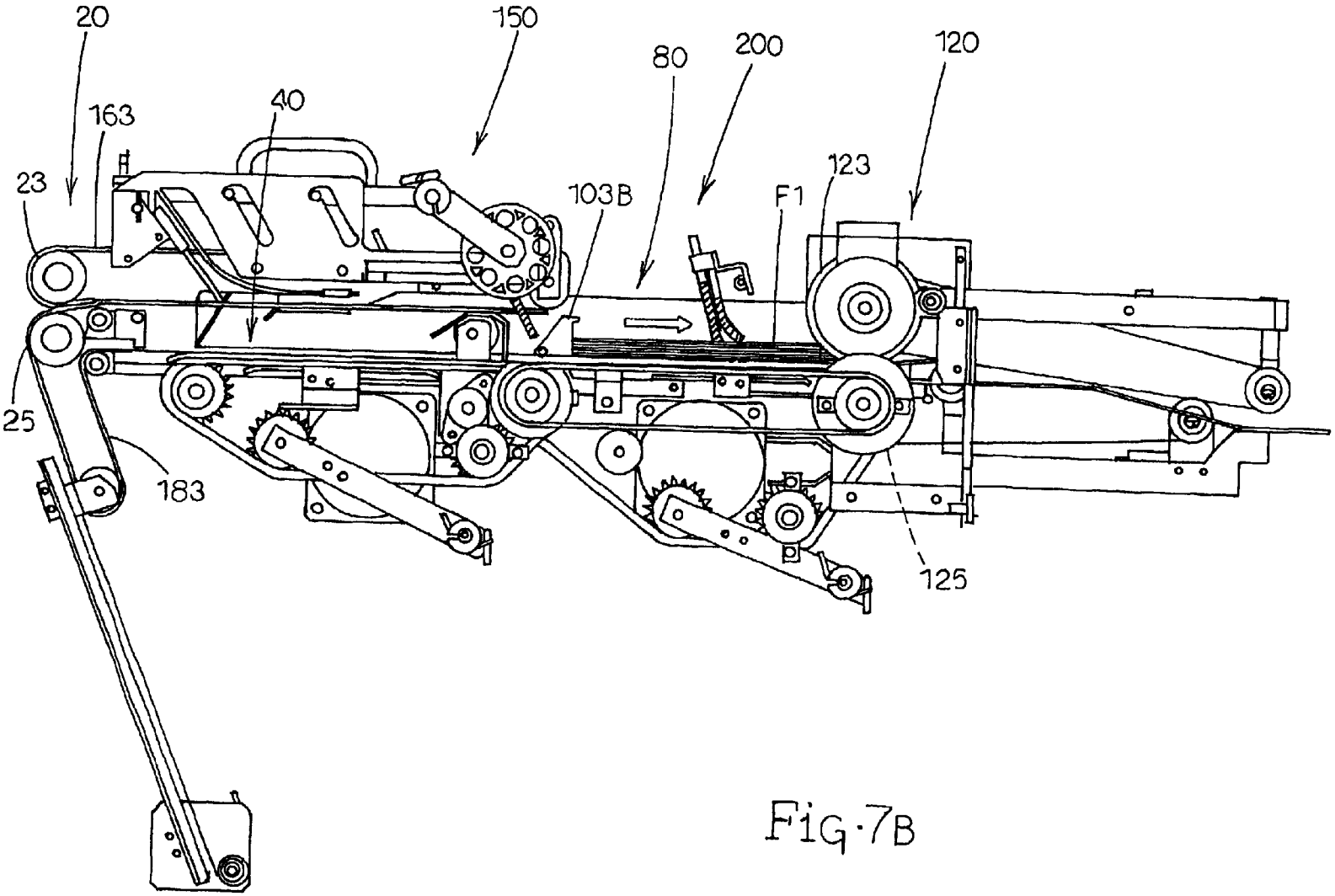
FIG. 7B is a side elevation view of the collector apparatus illustrated in FIG. 7A wherein the stack of sheets is being transported out from the apparatus.

Referring to FIGS. 1, 7A and 7B, the operation of collector apparatus 10 while in flats mode will now be described. Analogously to use of the term "letters," the term "flats" as used herein refers to either one flat or a set or stack of flats. To position adjustable transport assembly 150 in flats mode, lower transport subassembly 180 is adjusted such that lower nose roller 186 and take-up roller 189 are moved into their respective extended positions, as indicated by the solid lines in FIG. 1. In this extended position, it can be seen that lower transport subassembly 180 and its lower endless belt 183 extend over a large portion of first staging area 40. However, because many types of flat units are greater in length than letter units (see, e.g., FIG. 7A), the remaining "exposed" portion of first staging area 40 can be utilized by collector apparatus 10 in the processing of flat-type material units.

As shown in FIGS. 7A and 7B, adjustment of collector apparatus 10 to the flats mode in effect defines or creates a third staging area, generally designated 200, that is distinct from first staging area 40 and second staging area 80. Depending on the lengthwise size of the flat units being processed—that is, the length of a flat unit from its leading edge to its trailing edge—this third staging area can be defined according to one of three configurations. In the first configuration, the third staging area is defined in part by one of pusher pins 63A and 63B. In the second configuration, the third staging area is defined in part by one of pusher pins 63A and 63B as well as one of pusher pins 103A and 103B. In the second configuration, one of pusher pins 63A and 63B "hands off" the flat unit to one of pusher pins 103A and 103B. In the third configuration, the third staging area is defined in part by one of pusher pins 103A and 103B, but not by pusher pins 63A or 63B. In each of the three configurations, the third staging area is further defined by one of stop pins 105A and 105B. Thus, in the third configuration, the third staging area can be essentially equivalent to second staging area 80. It thus can be seen that the third stage Is adjustable to accommodate different flat sizes.

Input device 20 drives flats into adjustable transport assembly 150, which carries the flats into the third staging area as defined hereinabove. Specifically, flats are carried from input device 20 through adjustable transport assembly 150 by being driven between upper endless belt 163 of upper transport subassembly 160 and lower endless belt 183 of lower transport subassembly 180. In this manner, flats pass over at least a portion of first staging area 40 and are discharged into the third staging area, which can include second staging surface 83 as well as a portion of first staging surface 43. Pressure rollers 241A and 241B are situated in the elevated position indicated by solid lines, and are not employed to handle flats. Second conveying member 93 is synchronized in flats mode with adjustable transport assembly 150 such that the flats will become registered against one of stop pins 105A or 105B of second conveying member 93 (see FIG. 2) upon entry into the third staging area. At this point, the flats can be staged in the third staging area for a period of time prior to further transport through collector apparatus 10 for the purpose of synchronizing upstream and/or downstream operations. Subsequently, the flats are driven out from the third staging area by passing between upper roller 123 and lower roller 125 of exit device 120 and, if provided, between upper exit transport belt 127 and lower exit transport belt 129 of exit device 120.

It will be understood that if the module immediately upstream of collector apparatus 10 is a folder unit, the folder unit can be configured to permit flats to pass therethrough without being folded into letters when collector apparatus 10 is operating in flats mode.

Referring to FIGS. 7A and 7B, additional examples of the method of operation of collector apparatus 10 while in flats mode are illustrated. In FIG. 7A, a single flat F has been introduced into adjustable transport assembly 150 by input device 20. As described hereinabove, adjustable transport assembly 150 is configured in flats mode so that flat F passes over at least a portion of first staging area 40. Accordingly, flat F is driven between upper endless belt 163 and lower endless belt 183 of adjustable transport assembly 150 into the third staging area, thereby resulting in a stack of flats F1 being collected in the third staging area. Stack of flats F1 can be staged in the third staging area until it is desirable to advance stack F1 out from the third staging area to an appropriate downstream location.

For many form lengths, and particularly the longer form lengths, adjustable transport assembly 150 can drive flats far enough into the third staging area so as to bring stack of flats F1 into front end registration against stop pin (or pair of stop pins) 105A. In addition, pusher pin 63A of the first stage can be primarily responsible for driving stack of flats F1 into the nip of exit device 120. Thus, in many cases, pusher pin 103B of the second stage plays an ancillary role.

In other cases, and particularly when shorter form lengths are being processed, the function of pusher pin 103B in moving stack of flats F1 in the downstream direction is more significant. In FIG. 7B, for example, stack of flats F1 is being advanced in a downstream direction out from the third staging area by the urging of pusher pin (or pair of pusher pins) 103B. Thus, stack F1 eventually is engaged by upper roller 123 and lower roller 125 of exit device 120 for subsequent downstream transport.

As can be appreciated by those of skill in the art, collector apparatus 10 can also be employed as an accumulator to accumulate a plurality of single letters fed into first staging area 40 or a plurality of single flats fed into the third staging area. Preferably, some type of sensing device or counting device will be included with collector apparatus 10 at one or more points along the feed direction for these purposes. Sensing or counting devices suitable for use in accumulating-type equipment are known in the art.

As can further be appreciated, collector apparatus 10 is capable of handling flats and letters in both landscape and portrait orientations.

Figure 4B:
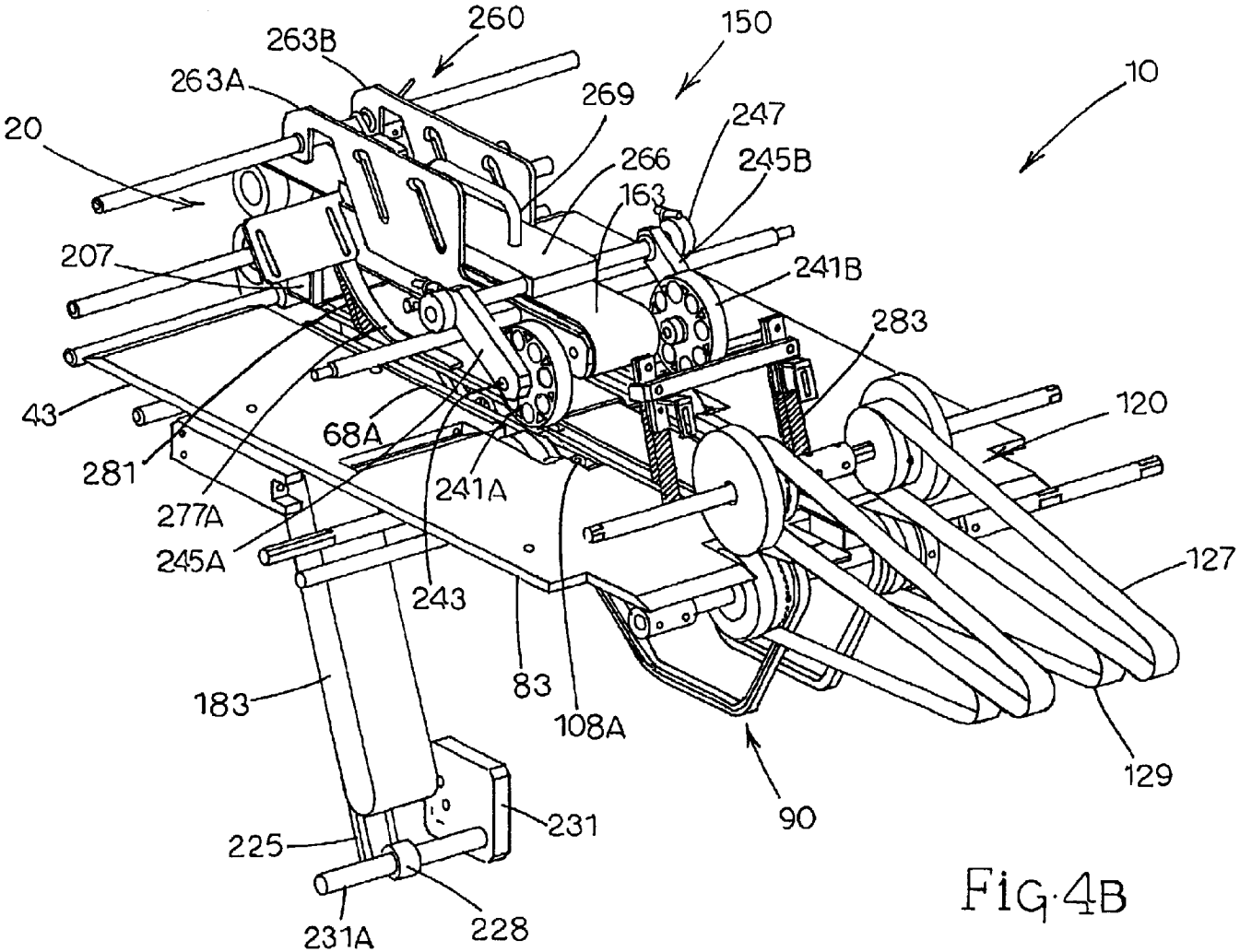
FIG. 4B is a perspective view of the collector apparatus illustrated in FIG. 4A.
Figure 4C:
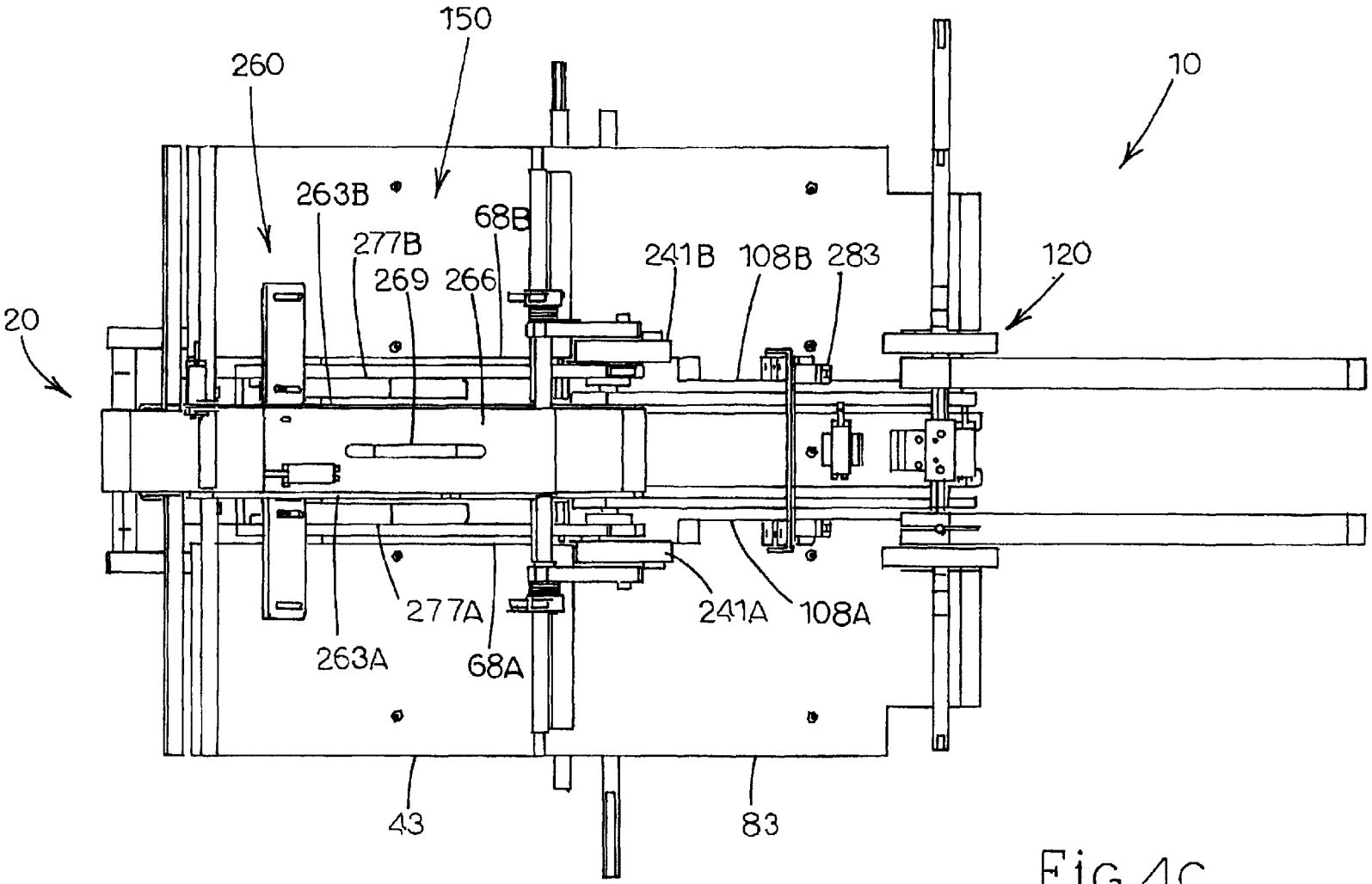
FIG. 4C is a top view of the collector apparatus illustrated in FIG. 4A.
Figure 5B:
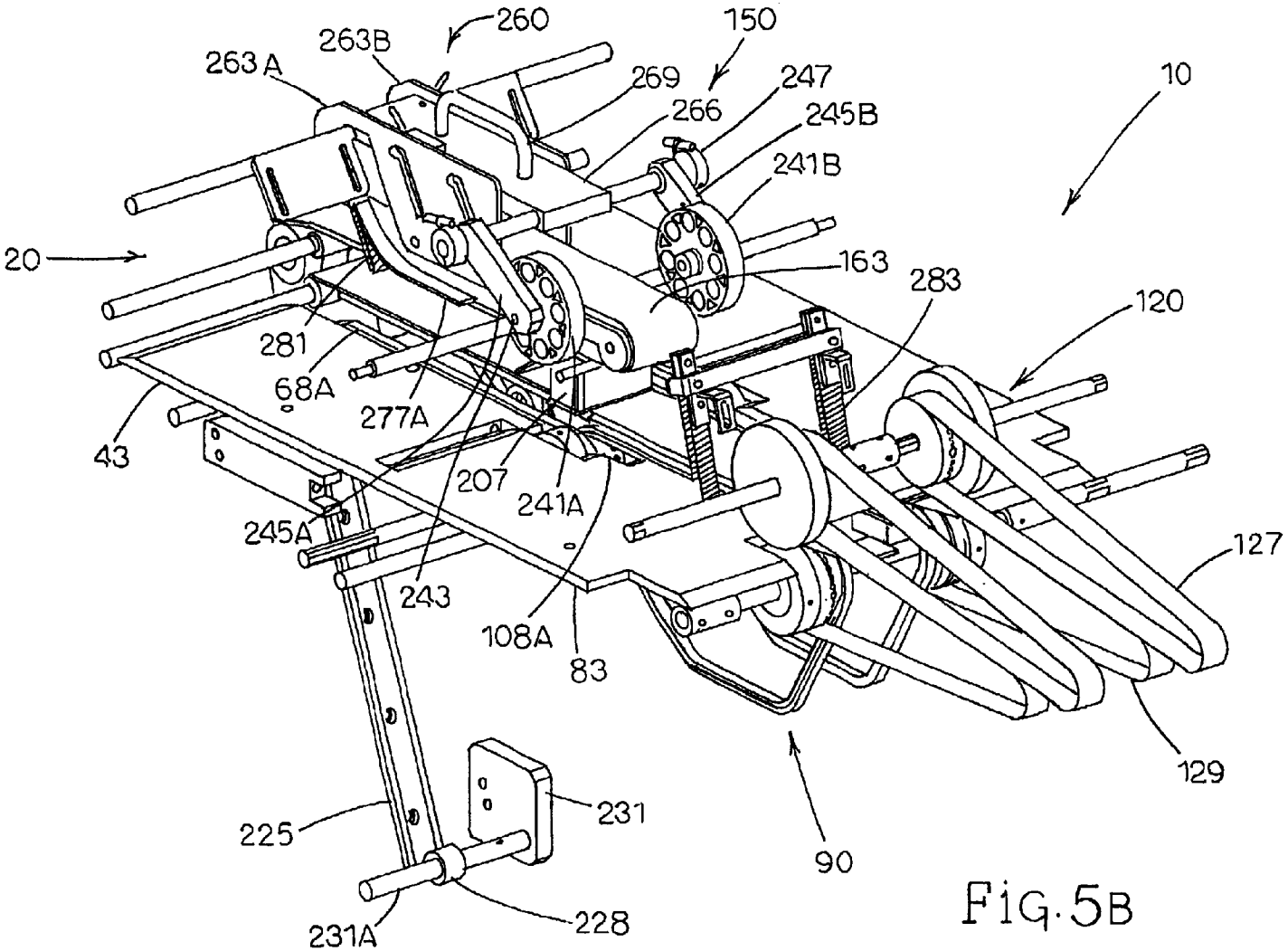
FIG. 5B is a perspective view of the collector apparatus illustrated in FIG. 5A.
Figure 5C:
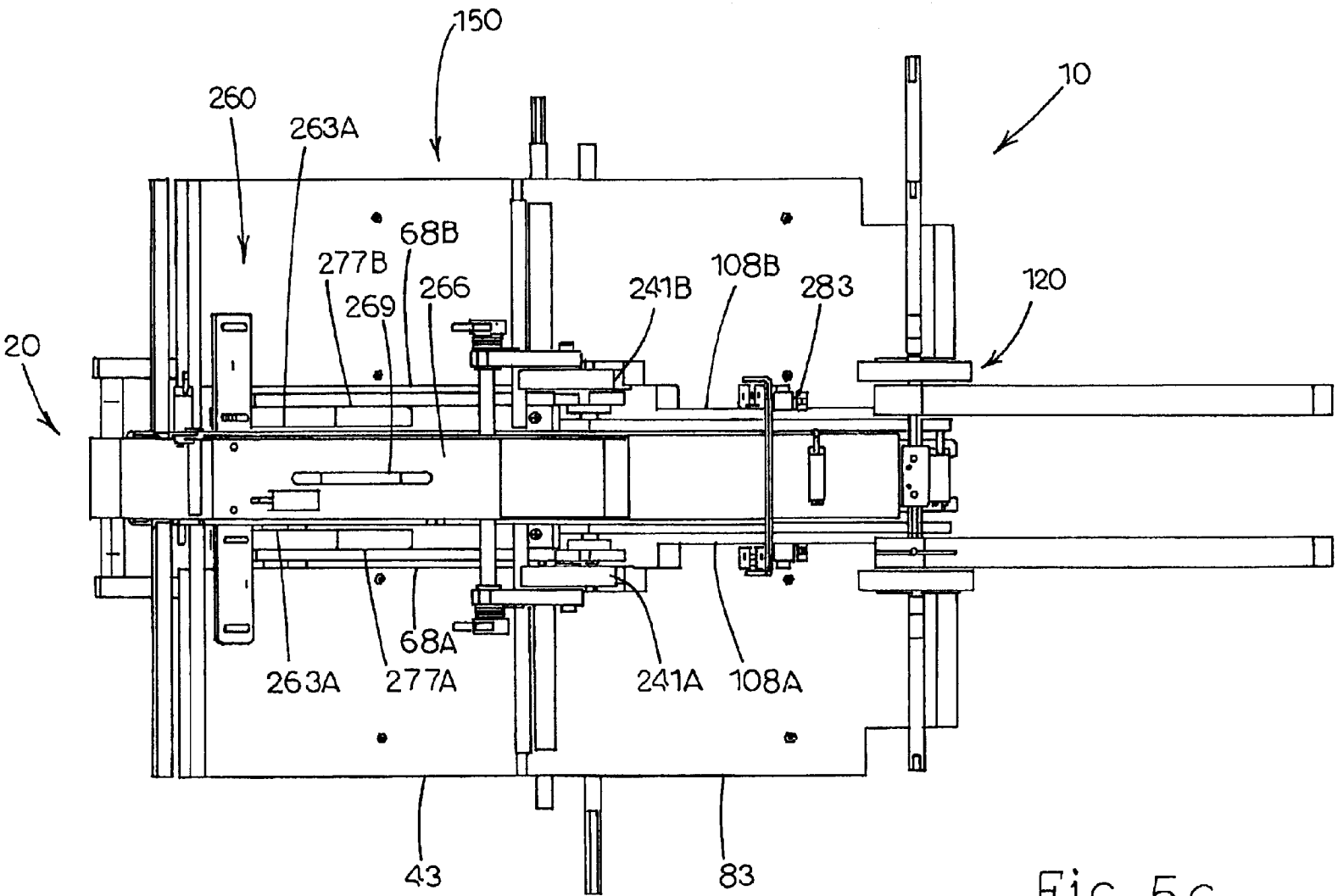
FIG. 5C is a top view of the collector apparatus illustrated in FIG. 5A.

The respective operations of collector apparatus 10 can also be described by referring to FIGS. 4A–4C, which illustrate collector apparatus 10 in letters mode, and FIGS. 5A–5C, which illustrate collector apparatus 10 in flats mode.

As further illustrated in FIGS. 4A–4C and FIGS. 5A–5C, adjustable transport assembly 150 can also include an upper mounting assembly, generally designated 260. Upper mounting assembly 260 comprises two lateral brackets 263A and 263B that are affixed to the main frame of collector apparatus 10. Upper mounting assembly 260 further comprises an adjustable frame assembly 266, situated between lateral brackets 263A and 263B, which is adjustable between the flats and letters modes by manipulation of a handle 269 attached to adjustable frame assembly 266. One or more transverse guide members 271A and 271B extending from adjustable frame assembly 266 are movably supported in one or more corresponding oblique slots 274A and 274B in each of lateral brackets 263A and 263B, rendering adjustable frame assembly 266 movable along a generally inclined direction with respect to lateral brackets 263A and 263B. In the letters mode shown in FIGS. 4A–4C, transverse guide members 271A and 271B are respectively located at the lowermost ends of slots 274A and 274B. In the flats mode shown in FIGS. 5A–5C, guide members 271A and 271B are respectively located at the uppermost ends of slots 274A and 274B.

Upper mounting assembly 260 also includes arcuate letter guide members 277A and 277B on either side of adjustable frame assembly 266. These letter guide members 277A and 277B are adjustable with adjustable frame assembly 266 between the flats and letters modes, but are only used in the letters mode. Thus, in the letters mode shown in FIGS. 4A–4C, letter guide members 277A and 277B are in a lowered position to provide a smooth guiding surface by which letters entering first staging area 40 are directed downwardly toward first staging surface 43. On the other hand, in the flats mode shown in FIGS. 5A–5C, letter guide members 277A and 277B are in an elevated position and do not perform any function on flats traveling through adjustable transport assembly 150.

As also shown in FIGS. 4A–5C, upper mounting assembly 260 includes one or more brushes 281 or sets of brushes 281 that move with adjustable frame assembly 266. Brushes 281 function to keep down the trailing edges of letters in first staging area 40. Additional brushes 283 are supported by the main frame of collector apparatus 10 to prevent flats or letters from backing up in second staging area 80. Finally, it can be seen that adjustable frame assembly 266 of upper mounting assembly 260 can be used to support pressure rollers 241A and 241B, such that pressure rollers 241A and 241B are adjusted between the flats and letters modes by manipulating adjustable frame assembly 266 as described hereinabove.

Figure 8:
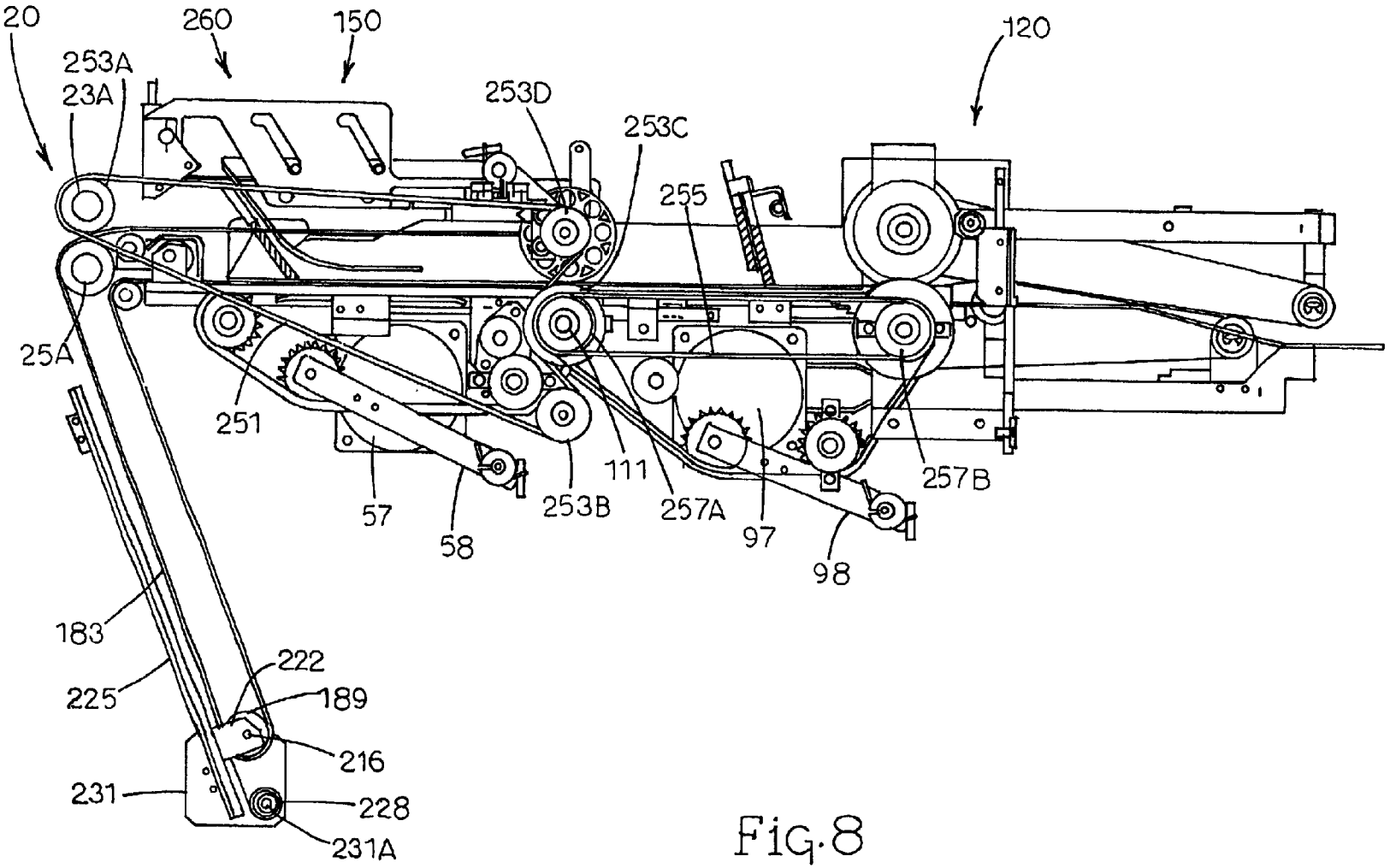
FIG. 8 is a side elevation view of the collector apparatus illustrated in FIG. 1, in which the details of an exemplary transmission system are provided.

Referring to FIG. 8, one example of a means for driving the moving components of upper and lower transport subassemblies 160 and 180 of adjustable transport assembly 150, as well as output device 120, is illustrated in which input device 20 provides the driving force. In this example, input device 20 mechanically communicates with upper transport subassembly 160, lower transport subassembly 180, and output device 120 through suitable transmission means. As illustrated in FIG. 8, the transmission means includes an endless member such as a belt 251 wrapped around rotatable elements 253A–253D. Rotatable element 253A rotates about and is driven by upper axis 23A of input device 20 and rotatable element 253C rotates about axis 111, thereby transmitting power from input device 20 to adjustable transport assembly 150. In addition, another endless member such as a belt 255 is wrapped around rotatable elements 257A and 257B. Rotatable element 257A rotates about axis 111 and rotatable element 257B rotates about a lower axis of output device 120, thereby transmitting power to output device 120.

Figure 9:
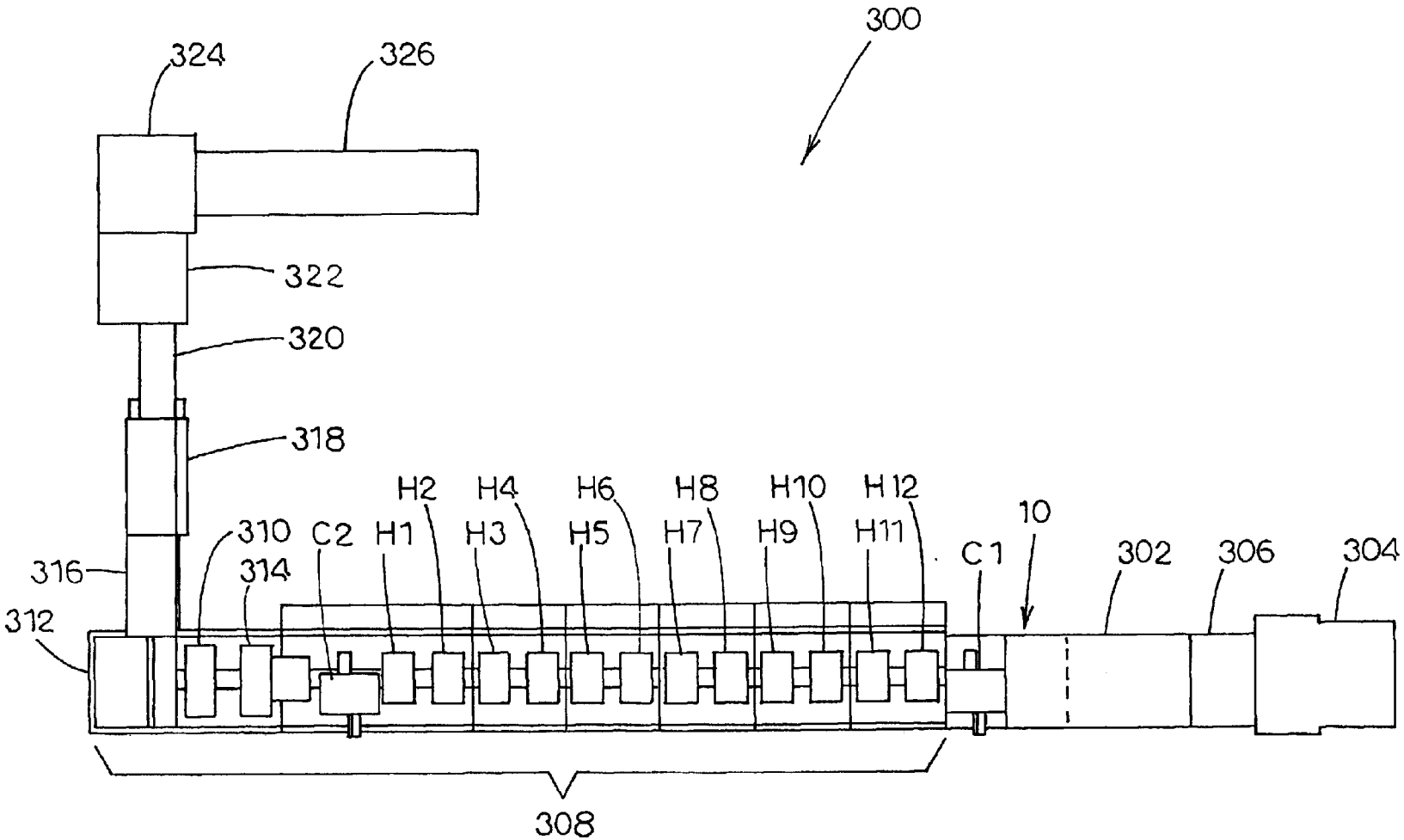
FIG. 9 is a schematic view of a mail processing system according to the present invention in which the collector apparatus illustrated in FIGS. 1–8 is incorporated.
Figure 10:
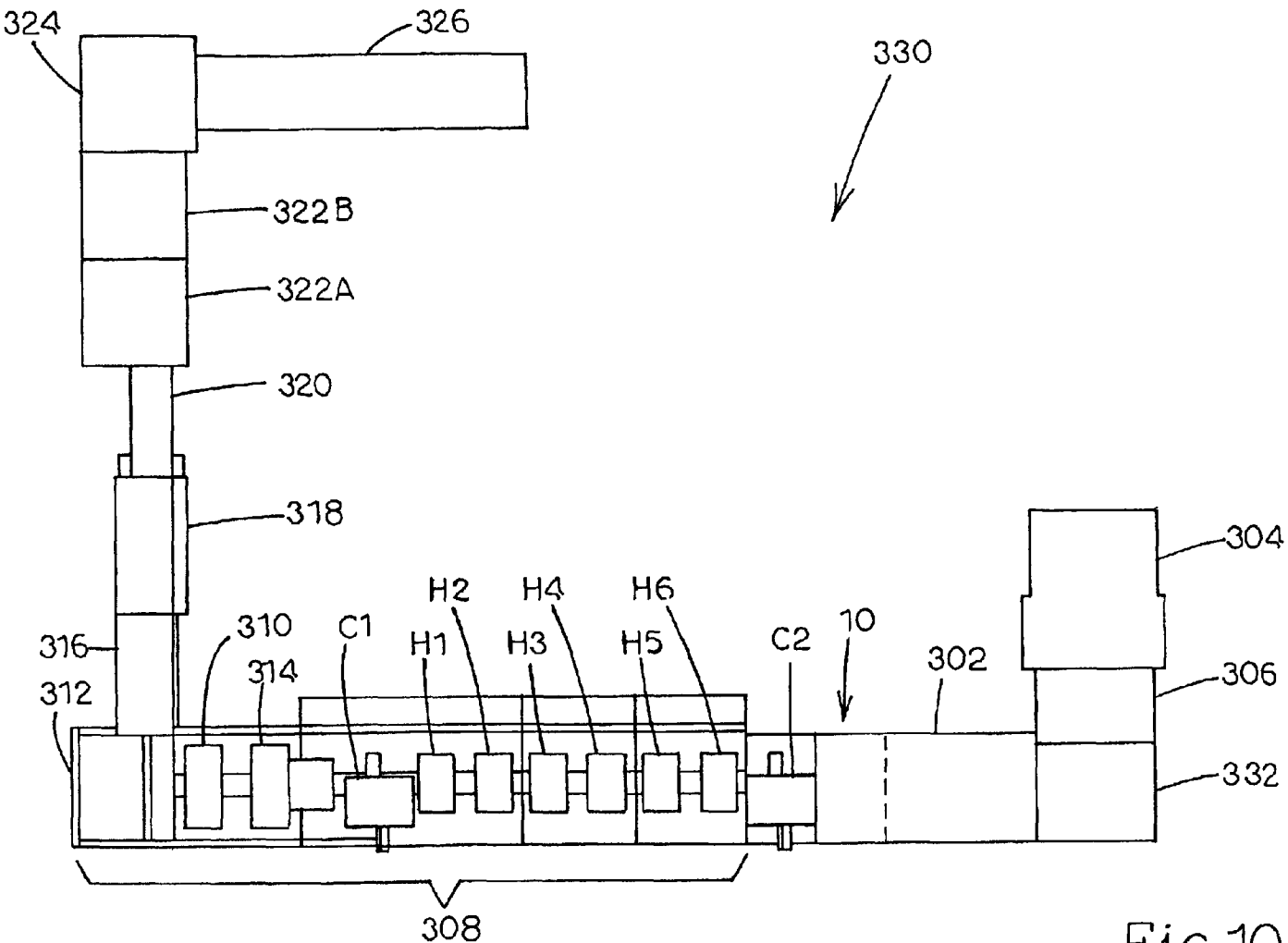
FIG. 10 is a schematic view of another mail processing system according to the present invention in which the collector apparatus illustrated in FIGS. 1–8 is incorporated.
Figure 11:
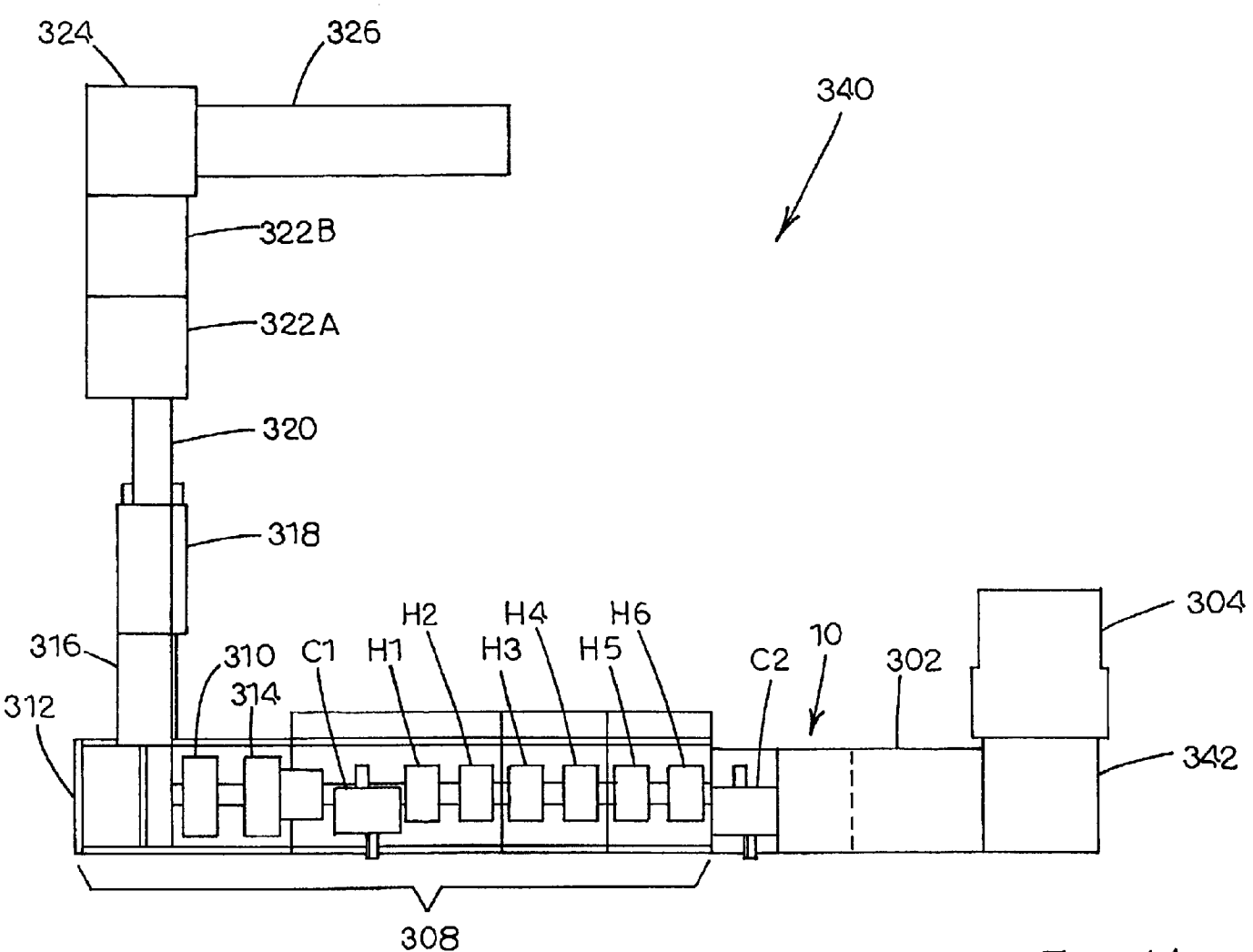
FIG. 11 is a schematic view of yet another mail processing system according to the present invention in which the collector apparatus illustrated in FIGS. 1–8 is incorporated.

FIGS. 9–11 refer to non-limiting examples of mail processing or document handling systems, generally designated 300, 330 and 340, respectively, in which collector apparatus 10 can be operationally integrated.

Referring to FIG. 9, system 300 includes an accumulator/folder/collector module 302 that incorporates collector apparatus 10. A cutter/read module 304 and a hold module 306 are situated upstream of accumulator/folder/collector module 302. Cutter/read module 304 cuts a continuous stream of material into singularly-sized material units. A bulk loading device could be included with (or a bulk loading function could be implemented by) any one of these upstream modules. Each material unit constitutes, for example, a page of printed matter such as invoice information. Cutter/read module 304 can also use a suitable optical or image recognition system to read certain identifying information off each material unit, such as a bar code or address block, in order to logically associate a set of cut material units according to, for example, the mail recipient of such material units. This information can be used by the electronic control circuitry throughout the job being performed by system 300, in order to determine how the various modules and assemblies of system 300 operate on the set of material units being processed. Hold module 306 is essentially a staging device. Accumulator/folder/collector module 302 performs several functions. The accumulator portion accumulates several material units into a single stack. The folder portion is situated immediately downstream from the accumulator portion, and folds each material unit or entire set of material units according to a standard configuration such a z-fold, letter fold and so on, when collector apparatus 10 is operating in the letters mode. When, on the other hand, collector apparatus 10 is operating in the flats mode, the folder portion is adapted to permit the flats to pass through its rollers without being folded. The collector portion is situated immediately downstream from the folder portion, and is where collector apparatus 10 is situated according to the present invention.

In the system shown in FIG. 9, a mail inserter assembly, generally designated 308, is positioned downstream from accumulator/folder/collector module 302 and receives the output from collector apparatus 10. Examples of mail inserter assemblies are disclosed in U.S. Pat. Nos. 5,125,214 and 5,823,521, commonly owned herewith. Mail inserter assembly 308 includes a plurality of insert hoppers H1–H12 that add various types of insert material to the stream of material units passing thereby. The electronic control circuitry associated with system 300 uses the information obtained by cutter/read module 304 to determine which, if any, insert materials are to be added to the material stream. Inserter assembly 308 further includes a diverter module 310 to handle rejected materials, an envelope hopper and feeding module 312, and an envelope stuffer 314 that inserts a logical set of material units and inserts into an envelope. One or more computer units C1 and C2 are also provided in system 300 to enable peripheral interface with a system operator. Stuffed envelopes then enter a turnover module 316, which may be necessary for turning the envelopes over in preparation for being sealed by a sealing unit 318 positioned downstream. After each envelope is sealed, it is transported across a bridge 320 to a postage meter 322. Postage meter 322 weighs each envelope, determines the appropriate amount of postage to be charged, and prints the postage on the envelope according to a standard postage symbology. If envelope stuffer 314 is bypassed or not provided, the material units can be passed to a finishing station 324 that carries out an appropriate finishing operation if needed. By way of example, finishing station 324 could comprise a stitcher, a booklet maker, a perfect binder, a collator, and/or a shrink wrapper. A conveyor assembly 326 can be positioned to receive the output from finishing station 324 to transport the envelopes to an appropriate location within the job site.

Referring to FIG. 10, system 330 is similar to system 300 in FIG. 9. In FIG. 8, however, system 330 includes a turnover sequencing module 332 to effect a right-angle turn of the material stream prior to entry into accumulator/folder/collector module 302. Examples of systems in which sheets must be physically turned in order to effect a change in conveying direction are disclosed in U.S. Pat. Nos. 5,362,039 and 5,439,208. FIG. 10 also shows that different or additional postage meters 322A and 322B can be used.

Referring to FIG. 11, system 340 is similar to system 330 in FIG. 10, except that system 340 substitutes a right-angle staging apparatus 342 in the place of turnover sequencing module 332 of system 330. Right-angle staging apparatus 342 can provide several advantages over turnover sequencing module 332, depending on the specific circumstances of the job to be executed.

As one advantage, right-angle staging apparatus 342 does not physically turn material units over. Instead, the material units handled by right-angle staging apparatus 342 are converted from landscape to portrait configuration, or vice versa. Right-angle staging apparatus 342 according to certain novel embodiments is disclosed in U.S. patent application Ser. No. 09/568,876, commonly owned herewith, the disclosure of which is incorporated herein by reference.

It can therefore be seen from the foregoing description that the invention provides a collector apparatus that is easily adjustable to process either flats as a single-stage device or letters as a multi-stage device, and further provides a method for carrying out flats processing, letters processing, and the conversion from one mode of operation to the other mode of operation. The invention can be implemented in-line as part of a material processing system, thereby rendering the processing system likewise capable of handling both flats and letters. Moreover, the invention is compatible with existing or conventional upstream and downstream equipment.

It will be understood that various details of the invention may be changed without departing from the scope of the invention. Furthermore, the foregoing description is for the purpose of, illustration only, and not for the purpose of limitation—the invention being defined by the claims.

What is claimed is:

1. A collector apparatus adapted for handling letter and flat units, the apparatus comprising:

(a) a first staging area comprising a first staging surface disposed along an at least substantially horizontal plane and a first stage transport assembly;

(b) a second staging area generally disposed downstream from the first staging area, the second staging area comprising a second staging surface disposed along an at least substantially horizontal plane and a second stage transport assembly;

(c) a third staging area comprising at least a portion of the second staging area; and (d) a conveying device adjustable between a letters mode position using the first and second staging areas and a flats mode position using the third staging area, wherein:

(i) in the letters mode position, a first material flow path is defined through the first and second staging areas and the conveying device is adapted for letters to be advanced by the conveying device to and staged in the first staging area in an at least substantially horizontal orientation for subsequent advancement to the second staging area; and (ii) in the flats mode position, a second material flow path is defined through the third staging area wherein the conveying device is adapted for flats to be advanced by the conveying device to pass over at least a portion of the first staging area and advance to the third staging area.

2. The apparatus according to claim 1 wherein the first stage transport assembly comprises a movable first endless member.

3. The apparatus according to claim 2 wherein the first stage transport assembly includes a pusher element attached to the first endless member.

4. The apparatus according to claim 3 wherein the first stage transport assembly includes a registration element attached to the first endless member.

5. The apparatus according to claim 2 wherein the first stage transport assembly includes a registration element attached to the first endless member.

6. The apparatus according to claim 2 wherein the second stage transport assembly comprises a second endless member.

7. The apparatus according to claim 6 wherein the first stage transport assembly rotates around a plurality of first rotatable elements, the second stage transport assembly rotates around a plurality of second rotatable elements, and at least one of the first rotatable elements and at least one of the second rotatable elements share a common axis of rotation.

8. The apparatus according to claim 6 wherein the second stage transport assembly includes a pusher element attached to the second endless member.

9. The apparatus according to claim 8 wherein the second stage transport assembly includes a registration element attached to the second endless member.

10. The apparatus according to claim 6 wherein the second stage transport assembly includes a registration element attached to the second endless member.

11. The apparatus according to claim 1 wherein the third staging area comprises the second staging surface and at least a portion of the first staging surface.

12. The apparatus according to claim 1 wherein the third staging area comprises a registration element movable by the second stage transport assembly.

13. The apparatus according to claim 12 wherein the third staging device comprises a pusher element movable by the first stage transport assembly.

14. The apparatus according to claim 13 wherein the third staging device comprises a pusher element movable by the second stage transport assembly.

15. The apparatus according to claim 12 wherein the third staging device comprises a pusher element movable by the second stage transport assembly.

16. The apparatus according to claim 1 wherein the conveying device comprises a retractable first conveying assembly, the retractable first conveying assembly is extended over at least a portion of the first staging surface in the flats mode position of the conveying device, and the retractable first conveying assembly is retracted to expose the first staging surface in the letters mode position.

17. The apparatus according to claim 16 wherein the retractable first conveying assembly comprises a movable first endless belt, the movable endless belt is extended over at least a portion of the first staging surface in the flats mode position of the conveying device, and the movable first endless belt is retracted to expose the first staging surface in the letters mode position.

18. The apparatus according to claim 17 comprising an input device operatively communicating with an upstream end region of the first staging area in the letters mode position, and operatively communicating with an upstream end region of the third staging area through the conveying device in the flats mode position.

19. The apparatus according to claim 16 wherein the retractable first conveying assembly comprises a first rotatable element, the first rotatable element disposed at an upstream end region of the first staging area in the letters mode position, and alternatively disposed at a downstream end region of the first staging area in the flats mode position.

20. The apparatus according to claim 19 wherein the retractable first conveying assembly comprises a first endless belt movable about the first rotatable element.

21. The apparatus according to claim 19 wherein the retractable first conveying assembly comprises a second rotatable element disposed at first elevation in the letters mode position, and alternatively disposed at a second elevation in the flats mode position, and wherein the second elevation is higher than the first elevation.

22. The apparatus according to claim 21 wherein the retractable first conveying assembly comprises a first endless belt movable about the first and second rotatable elements.

23. The apparatus according to claim 21 wherein the second rotatable element is biased toward the second elevation by a biasing component.

24. The apparatus according to claim 23 wherein the biasing component includes a constant-force spring.

25. The apparatus according to claim 16 wherein the conveying device comprises a second conveying assembly, the first conveying assembly includes a movable first endless belt, the second conveying assembly includes a movable second endless belt, and the second material flow path runs between the first and second endless belts.

26. The apparatus according to claim 25 comprising an input device operatively communicating with an upstream end region of the first staging area in the letters mode position, and operatively communicating with an upstream end region of the third staging area through the first and second endless belts in the flats mode position.

27. The apparatus according to claim 16 wherein the conveying device comprises a material unit guiding component adjustable between the flats mode position and the letters mode position, and wherein, in the letters mode position, the guiding component is disposed at a first elevation at which the guiding component is adapted to at least partially define the first material flow path, and in the flats mode position, the guiding component is disposed at a second elevation higher than the first elevation.

28. The apparatus according to claim 1 wherein the conveying device comprises a material unit guiding component adjustable between the flats mode position and the letters mode position, and wherein, in the letters mode position, the guiding component is disposed at a first elevation at which the guiding component is adapted to at least partially define the first material flow path, and in the flats mode position, the guiding component is disposed at a second elevation higher than the first elevation.

29. The apparatus according to claim 1 comprising an input device operatively communicating with an upstream end region of the first staging area in the letters mode position, and operatively communicating with an upstream end region of the third staging area through the conveying device in the flats mode position.

30. The apparatus according to claim 29 wherein the input device includes an axis of rotation in common with an output device of a folder apparatus.

31. The apparatus according to claim 29 wherein the input device is supported by an upstream material unit processing device.

32. The apparatus according to claim 29 comprising an output device operatively communicating with a downstream end of the second staging area.

33. The apparatus according to claim 1 comprising an output device operatively communicating with a downstream end of the second staging area.

34. A collector apparatus adapted for handling flat and letter units, the apparatus comprising:

(a) a first staging area comprising a first staging surface and a first stage transport assembly;

(b) a second staging area generally disposed downstream from the first staging area, the second staging area comprising a second staging surface and a second stage transport assembly;

(c) a third staging area comprising at least a portion of the second stage transport assembly; and (d) a conveying device adjustable between a letters mode position and a flats mode position and comprising a retractable first conveying assembly, the retractable first conveying assembly extending over at least a portion of the first staging surface in the flats mode position of the conveying device, and the retractable first conveying assembly retracting to expose the first staging surface in the letters mode position, wherein the retractable first conveying assembly further comprises a first rotatable element disposed at an upstream end region of the first staging area in the letters mode position, and alternatively disposed at a downstream end region of the first staging area in the flats mode position, the retractable first conveying assembly further comprises a second rotatable element disposed at a first elevation in the letters mode position, and alternatively disposed at a second elevation in the flats mode position, wherein the second elevation is higher than the first elevation, and further wherein the second rotatable element is biased toward the second elevation by a biasing component, and wherein:

in the letters mode position, a first material flow path is defined through the first and second staging; and in the flats mode position, a second material flow path is defined through the third staging area.

35. The collector apparatus of claim 34 wherein the biasing component includes a constant-force spring.

* * * * *